US010619629B2

(12) United States Patent
Lifson

(10) Patent No.: US 10,619,629 B2
(45) Date of Patent: Apr. 14, 2020

(54) DISCHARGE REED VALVE FOR RECIPROCATING REFRIGERATION COMPRESSOR

(71) Applicant: Carrier Corporation, Farmington, CT (US)

(72) Inventor: Alexander Lifson, Manlius, NY (US)

(73) Assignee: Carrier Corporation, Palm Beach Gardens, FL (US)

( * ) Notice: Subject to any disclaimer, the term of this patent is extended or adjusted under 35 U.S.C. 154(b) by 921 days.

(21) Appl. No.: 14/650,066

(22) PCT Filed: Oct. 4, 2013

(86) PCT No.: PCT/US2013/063411

§ 371 (c)(1),
(2) Date: Jun. 5, 2015

(87) PCT Pub. No.: WO2014/088695

PCT Pub. Date: Jun. 12, 2014

(65) Prior Publication Data

US 2015/0316044 A1 Nov. 5, 2015

Related U.S. Application Data

(60) Provisional application No. 61/734,137, filed on Dec. 6, 2012.

(51) Int. Cl.
*F04B 39/10* (2006.01)
*F04B 37/00* (2006.01)
(Continued)

(52) U.S. Cl.
CPC ..... *F04B 39/1073* (2013.01); *F04B 27/1009* (2013.01); *F04B 37/00* (2013.01);
(Continued)

(58) Field of Classification Search
CPC .. F04B 39/1073; F04B 27/1003; F04B 37/00; F04B 39/0022; F04B 39/0094; F04B 39/1066; F04B 39/108
(Continued)

(56) References Cited

U.S. PATENT DOCUMENTS 4,764,091 A * 8/1988 Ikeda ..... F04B 39/1073 137/855
4,978,285 A 12/1990 Da Costa
(Continued)

FOREIGN PATENT DOCUMENTS

CN 1209159 A 2/1999
CN 1611784 A * 5/2005
(Continued)

OTHER PUBLICATIONS

English Translation of CN 1611784 obtained on Sep. 7, 2017.*
(Continued)

*Primary Examiner* — Dominick L Plakkoottam
*Assistant Examiner* — Connor J Tremarche
(74) *Attorney, Agent, or Firm* — Bachman & LaPointe, P.C.

(57) ABSTRACT

A backer for a reed valve has: a first surface for engaging the valve reed; a second surface opposite the first surface; a base portion for mounting to a compressor housing; a distal portion for engaging a distal portion of the reed; and at least one trunk connecting the base portion to the distal portion. The first surface is transversely convex along a portion of the trunk. The trunk is relatively wider near the base portion than near the distal portion.

19 Claims, 18 Drawing Sheets

(51) Int. Cl.
*F04B 39/00* (2006.01)
*F04B 27/10* (2006.01)

(52) U.S. Cl.
CPC ..... *F04B 39/0022* (2013.01); *F04B 39/0094* (2013.01); *F04B 39/108* (2013.01); *F04B 39/1066* (2013.01)

(58) Field of Classification Search
USPC ..... 417/569
See application file for complete search history.

(56) References Cited

U.S. PATENT DOCUMENTS

| | | | | |
|---|---|---|---|---|
| 5,601,118 | A * | 2/1997 | Jang | F04C 29/128 137/856 |
| 5,672,053 | A | 9/1997 | Sabha | |
| 5,885,064 | A | 3/1999 | McCoy | |
| 5,934,305 | A * | 8/1999 | Cho | F04B 39/1066 137/15.18 |
| 6,099,259 | A * | 8/2000 | Monk | F04B 39/0094 417/15 |
| 6,569,347 | B1 | 5/2003 | Yajima et al. | |
| 2007/0231167 | A1 * | 10/2007 | Tsukamoto | F04B 39/1073 417/571 |
| 2008/0202613 | A1 * | 8/2008 | Yamaoka | F04B 39/1073 137/855 |
| 2009/0028733 | A1 * | 1/2009 | Duwel | F04B 39/1066 417/546 |

FOREIGN PATENT DOCUMENTS

| | | | |
|---|---|---|---|
| CN | 1806122 | A | 7/2006 |
| CN | 2859004 | Y | 1/2007 |
| CN | 201096069 | Y | 8/2008 |
| CN | 101313151 | A | 11/2008 |
| CN | 201696259 | U | 1/2011 |
| GB | 2156046 | A | 10/1985 |
| GB | 2407347 | A | 4/2005 |
| WO | 2006/027864 | A1 | 3/2006 |
| WO | 2007/116989 | A1 | 10/2007 |

OTHER PUBLICATIONS

International Search Report and Written Opinion for PCT/US2013/063411, dated Feb. 6, 2014.
European Response for EP Patent Application No. 13776931.1, dated Jul. 30, 2015.
Chinese Office action for CN Patent Application No. 201380063728.2, dated Jul. 5, 2016.
Chinese Office action dated Feb. 28, 2017 for CN Patent Application No. 201380063728.2.

* cited by examiner

DISCHARGE REED VALVE FOR RECIPROCATING REFRIGERATION COMPRESSOR

CROSS-REFERENCE TO RELATED APPLICATION

Benefit is claimed of U.S. Patent Application Ser. No. 61/734,137, filed Dec. 6, 2012, and entitled "Reciprocating Refrigeration Compressor Discharge Valve Backer", the disclosure of which is incorporated by reference herein in its entirety as if set forth at length.

BACKGROUND

The present disclosure relates to refrigeration compressors. More particularly, it relates to displacement compressors (e.g., reciprocating piston compressors) utilized to compress gases such as low global warming potential (GWP) and natural refrigerants.

In a reciprocating compressor a piston head is driven between a lower position at which a fluid to be compressed enters the compression cylinder, and an upper or "top" position at which the compressed fluid is driven outwardly of the cylinder. A valve plate is typically placed at the top of the cylinder. The term "top" and "bottom" do not mandate any relative or absolute vertical orientation, but instead only to a relative position in the cylinder. The valve plate carries both inlet (suction) and outlet (discharge) valves for allowing the flow of fluid into the cylinder, and out of the cylinder at appropriate points in the reciprocating movement of the piston. In reciprocating piston compressors and the like, pressure-actuated valves typically open and close once during each shaft revolution of the compressor.

Various types of valves are known, and various types of valve plates have been utilized. One type of compressor valving structure uses reed valves. A reed valve may cover a plurality of circumferentially spaced ports. When the valve closes, it contacts the valve seat due to valve stiffness and/or pressure actuation, thus sealing flow out of the cylinder for the suction valve, or into the cylinder for the discharge valve.

A recent compressor configuration having reed valves for suction and discharge purposed is seen in U.S. Ser. No. 61/696,729, filed Sep. 4, 2012. Such compressors protect the discharge reeds against overflexing via a rigid backer. Such a backer has a generally convex (convexity about transverse axes when viewed in a longitudinal section) underside complementary to a concave outboard/upper face of the reed in a maximum desired open condition.

SUMMARY

One aspect of the disclosure involves a backer for a reed valve. The backer has: a first surface for engaging the valve reed; a second surface opposite the first surface; a base portion for mounting to a compressor housing; a distal portion for engaging a distal portion of the reed; and at least one trunk connecting the base portion to the distal portion. The first surface is transversely convex along a portion of the trunk. The trunk is relatively wider near the base portion than near the distal portion.

In various embodiments, the distal portion comprises a plurality of lobes and the at least one trunk comprises a plurality of trunks.

In various embodiments, the plurality of lobes is a plurality of contiguous lobes.

In various embodiments, the plurality of trunks and the plurality of lobes are equal in number. In various embodiments, the number is three.

In various embodiments, the base portion has exactly two bolt holes.

In various embodiments, the width of the trunk at a location 35% of a span from a proximal end is at least 15% greater than the width of the trunk at a location 35% of the span from a distal end.

In various embodiments, the width of the trunk at a location 30% of a span from a center of a mounting hole to a center of a lobe is at least 15% greater than the width of the trunk at a location 30% of the span from the center of the to the center of the mounting hole.

In various embodiments, an inter-trunk gap has a length of 10-30% of a span from a center of a mounting hole to a center of a lobe.

In various embodiments, the trunk has a lateral protrusion.

In various embodiments, the backer consists essentially of stamped steel.

Another aspect of the disclosure involves a compressor valve assembly comprising: a valve plate having: a mounting surface portion; a port; and a seat surrounding the port; said backer; and a reed having: a base mounted to the mounting surface portion sandwiched between the mounting surface portion and the base portion of the backer; and a distal portion positioned to flex between a closed condition closing the port and an open condition clear of the port.

In various embodiments, there are a plurality of said ports.

In various embodiments, the reed is a single reed mounted to control flow through the plurality of said ports.

In various embodiments, the backer has a planform proportionately wider than a planform of the reed near the base portion compared with near the distal portion.

In various embodiments, the width of the trunk at a location 30% of the span from the proximal end is at least 15% greater than the width of a corresponding trunk of the reed at said location.

In various embodiments, the width of the trunk at a location 30% of the span from a center of a mounting hole to a center of a lobe is at least 15% greater than a width of a trunk of the reed at said location.

Another aspect of the disclosure involves a compressor including: a case having at least one cylinder and such a valve assembly; a crankshaft; and for each of said cylinders: a piston mounted for reciprocal movement at least partially within the cylinder; a connecting rod coupling the piston to the crankshaft; and a pin coupling the connecting rod to the piston, the pin having: first and second end portions mounted in first and second receiving portions of the piston; and a central portion engaging the connecting rod.

In various embodiments, an electric motor is within the case coupled to the crankshaft.

In various embodiments, the valve is a discharge valve.

In various embodiments, there are a plurality of said ports.

In various embodiments, the reed is a single reed mounted to control flow through the plurality of said ports.

Another aspect of the disclosure involves a method for using the compressor comprising: running the compressor so that the reed alternates between said open and closed conditions.

Another aspect of the disclosure involves a method for manufacturing such a compressor. The method comprises at least one of: replacing an existing backer with said backer, the existing backer not being relatively wider near a base portion than near a distal portion; or reengineering a configuration of an existing backer, the existing backer not being relatively wider near a base portion than near a distal portion.

In various embodiments, relative to the existing backer any combination of: an inter-trunk hole is shortened by at least 20%, more particularly, 30-60%; an inter trunk hole length asymmetry is added; a pair of lateral outboard protrusions are added; backer material is unchanged; thickness is not increased by more than 5% if at all; reed configuration is unchanged.

Another aspect of the disclosure involves a refrigeration system including such a compressor and: a refrigerant recirculating flowpath through the compressor; a first heat exchanger along the flowpath downstream of the compressor; an expansion device along the flowpath downstream of the first heat exchanger; and a second heat exchanger along the flowpath downstream of the expansion device.

In various embodiments, a refrigerant charge comprises R410a.

In various embodiments, system is a fixed refrigeration system further comprising: multiple refrigerated spaces; and a plurality of said second heat exchangers, each being positioned to cool an associated said refrigerated space. Another aspect of the disclosure involves a compressor valve assembly including such a backer.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
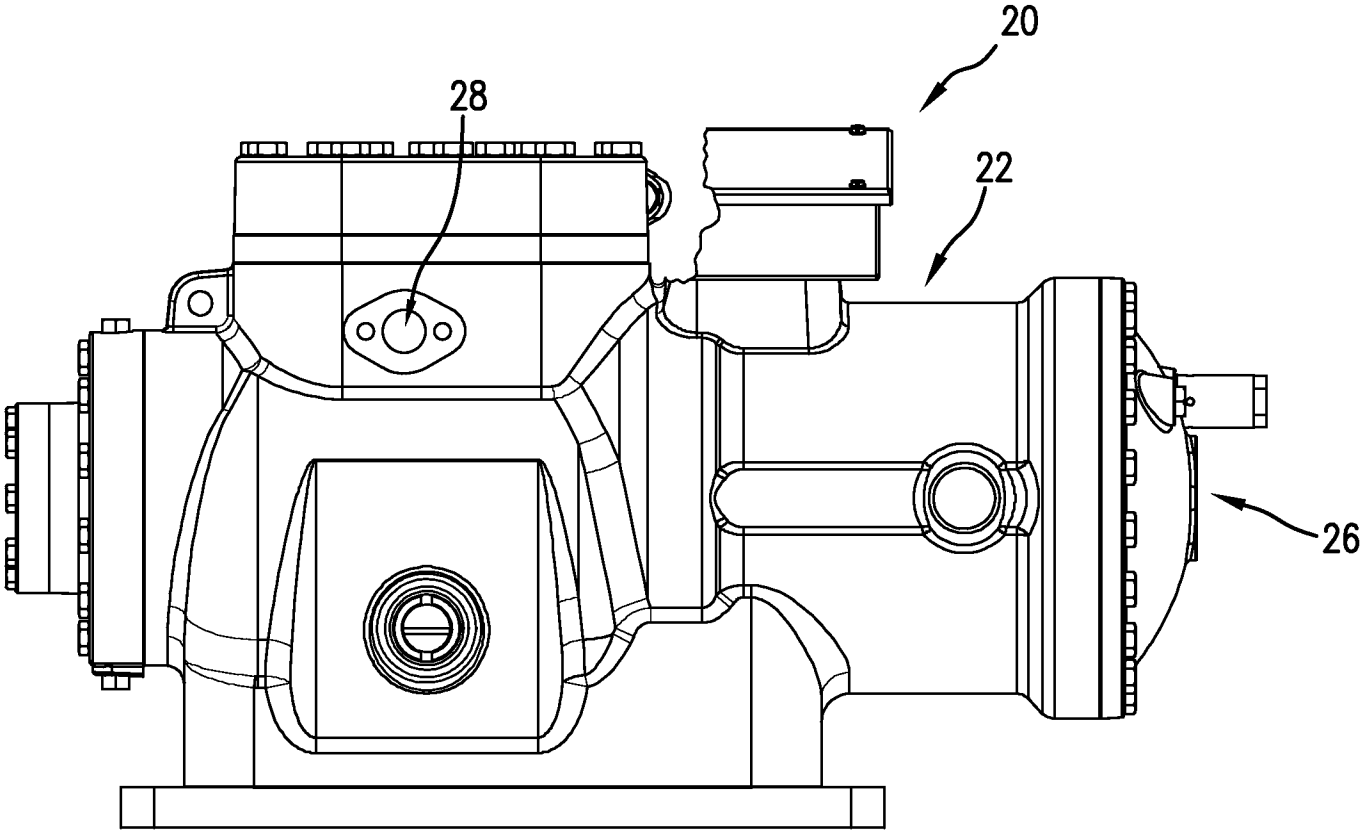
FIG. 1 is a side view of a compressor.
Figure 2:
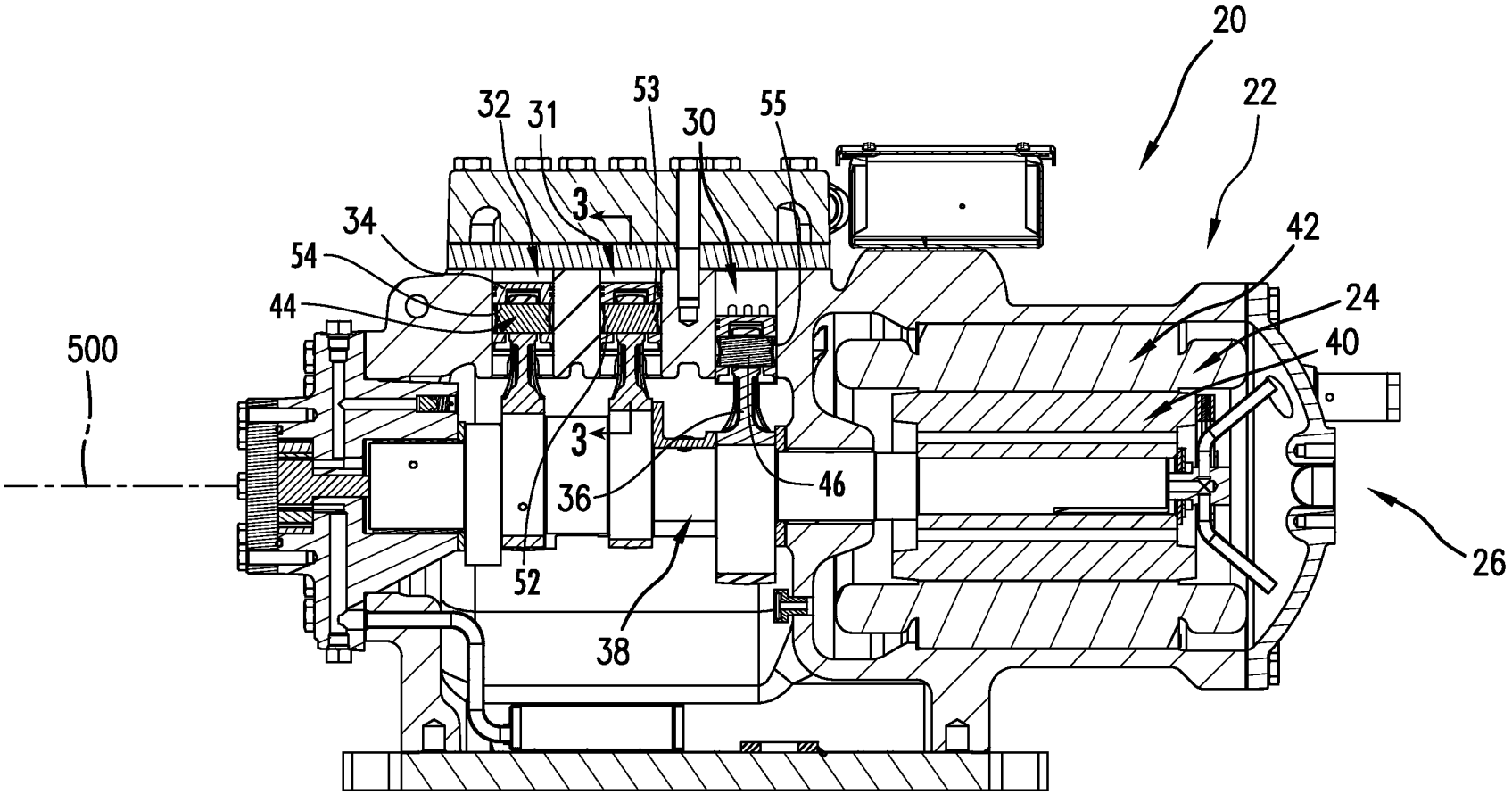
FIG. 2 is a vertical longitudinal sectional view of the compressor of FIG. 1.

FIGS. 1 and 2 show an exemplary compressor 20. The exemplary compressor is based upon the configuration shown in U.S. Ser. No. 61/696,729. However, the present teachings may be applied to alternative compressor configurations. As is discussed further below, the present disclosure teaches a new discharge valve backer which may be applied to such compressors. The compressor 20 has a housing (case) assembly 22. The exemplary compressor includes an electric motor 24 (FIG. 2). The exemplary case 22 has a suction port (inlet) 26 and a discharge port (outlet) 28. The housing defines a plurality of cylinders 30, 31, and 32. Each cylinder accommodates an associated piston 34 mounted for reciprocal movement at least partially within the cylinder. Exemplary multi-cylinder configurations include: in-line; V (vee); and horizontally opposed. The exemplary in-line compressor includes three cylinders. Each of the cylinders includes a suction location and a discharge location. For example, the cylinders may be coupled in parallel so that the suction location is shared/common suction plenum fed by the suction port 26 and the discharge location is a shared/common discharge plenum feeding the discharge port 28. In other configurations, the cylinders may share suction locations/conditions but have different discharge locations/conditions. In other configurations, the cylinders may be in series. An exemplary fluorocarbon-based refrigerant is R-410A. An exemplary carbon dioxide ($CO_2$)-based (e.g., at least 50% $CO_2$ by mass/weight) refrigerant is R-744 and others are discussed below.

Figure 3:
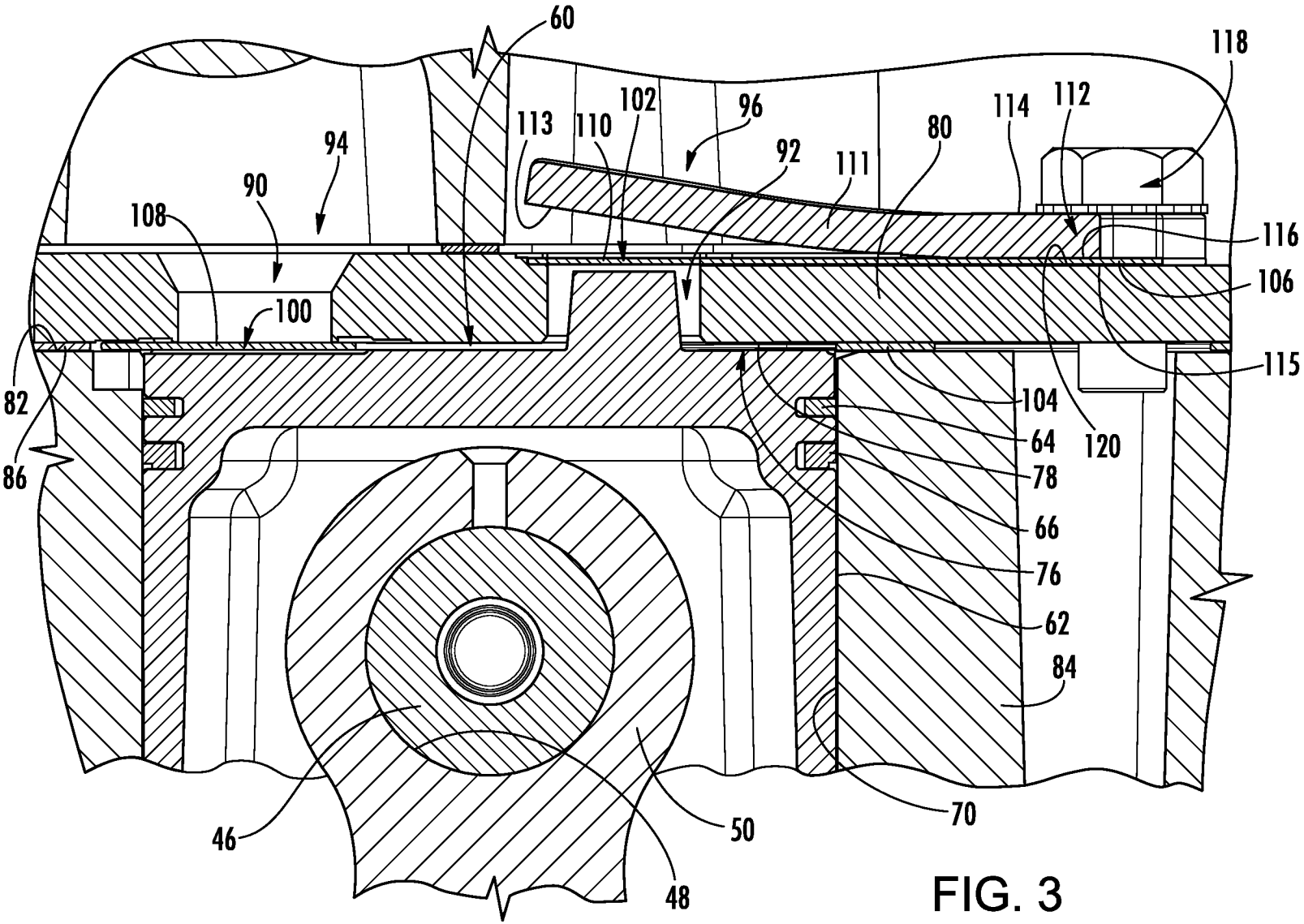
FIG. 3 is a partial vertical longitudinal sectional view of a cylinder of the compressor of FIG. 1.

Each of the pistons 34 is coupled via an associated connecting rod 36 to a crankshaft 38. The exemplary crankshaft 38 is held within the case by bearings for rotation about an axis 500. The exemplary crankshaft is coaxial with a rotor 40 and stator 42 of the motor 24. Each piston 30-32 is coupled to its associated connecting rod 36 via an associated wrist pin 44. FIG. 3 shows the pin 44 as having a central portion 46 mounted for rotation in an aperture 48 in a distal end portion 50 of the connecting rod 36. The exemplary aperture may be in a bushing (not shown) interference fit in a main piece of the connecting rod. The pin has first and second end portions 52 and 53 mounted in apertures 54 and 55 of associated receiving portions of the piston (e.g., via interference fit such as press fit or via a journaled fit).

The exemplary piston has a distal end face 60 (FIG. 3) and a lateral/circumferential surface 62. One or more sealing rings 64 may be carried in corresponding grooves 66 in the surface 62. The cylinders each have a cylinder wall/surface 70.

FIG. 3 shows a cylinder upper end/wall 76 formed by the underside 78 of a valve plate 80 (for a reed valve system). The exemplary valve plate 80 is mounted to the upper face 82 of a cylinder block 84 of the case with a gasket 86 in between for sealing.

Each cylinder has a plurality of inlet/suction ports 90 and outlet/discharge ports 92 extending through the plate 80 between the upper and lower surfaces thereof. Flows through the ports are controlled by valves. In this example, both inlet valves 94 and outlet valves 96 are reed valves. FIG. 3 further shows a suction valve reed 100 and a discharge valve reed 102. Each of the reeds has a proximal/base end portion (base) 104, 106 rigidly mounted to the case. Each of the reeds has a distal end portion 108, 110 which may shift via flexing of the reed to unblock the associated port and may relax to block the associated port. FIG. 3 further shows a discharge valve backer 111 to limit the range of flexing of the discharge valve reed.

Figure 6:
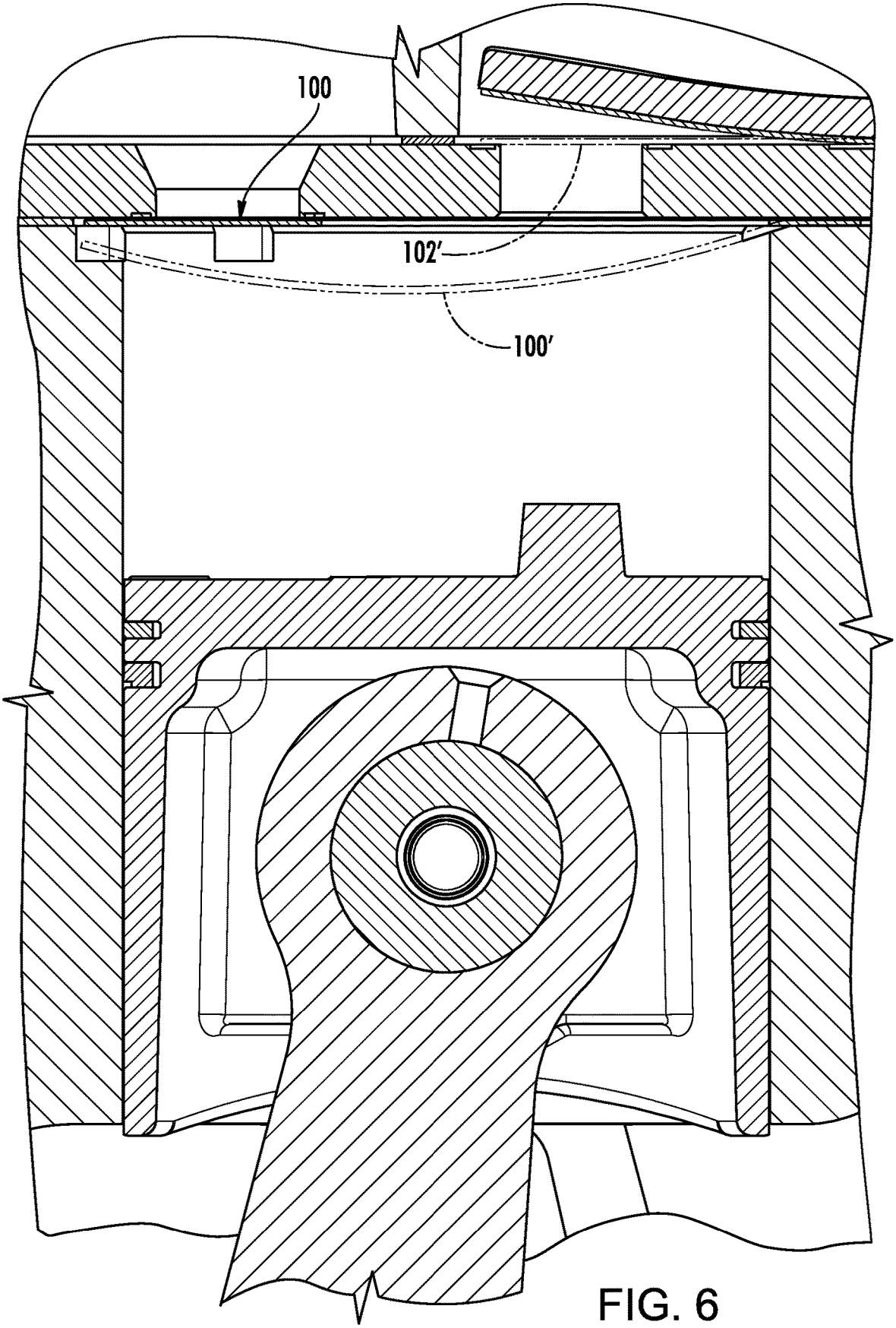
FIG. 6 is a view of the cylinder of FIG. 3 in an intermediate position with a compressing condition of the valves shown solid and an expanding/suction condition shown broken.

The valve backer 111 has a proximal/base end portion (base) 112. The backer has an underside/lower surface 113 and a top/upper surface 114 and the reed 102 has an underside/lower surface 115 and a top/upper surface 116. In the exemplary implementation, a fastener such as a bolt 118 sandwiches/clamps the reed base portion 106 between the backer base portion 112 and the upper surface/face 120 of the valve plate 80 with local contact between the reed underside 115 and plate upper surface 120 and reed upper surface 116 and backer underside 113. As is discussed further below, the exemplary reed has a relaxed condition essentially flat and closing the discharge ports and a flexed condition in essentially full length contact with the backer underside (FIG. 6).

Figure 4:
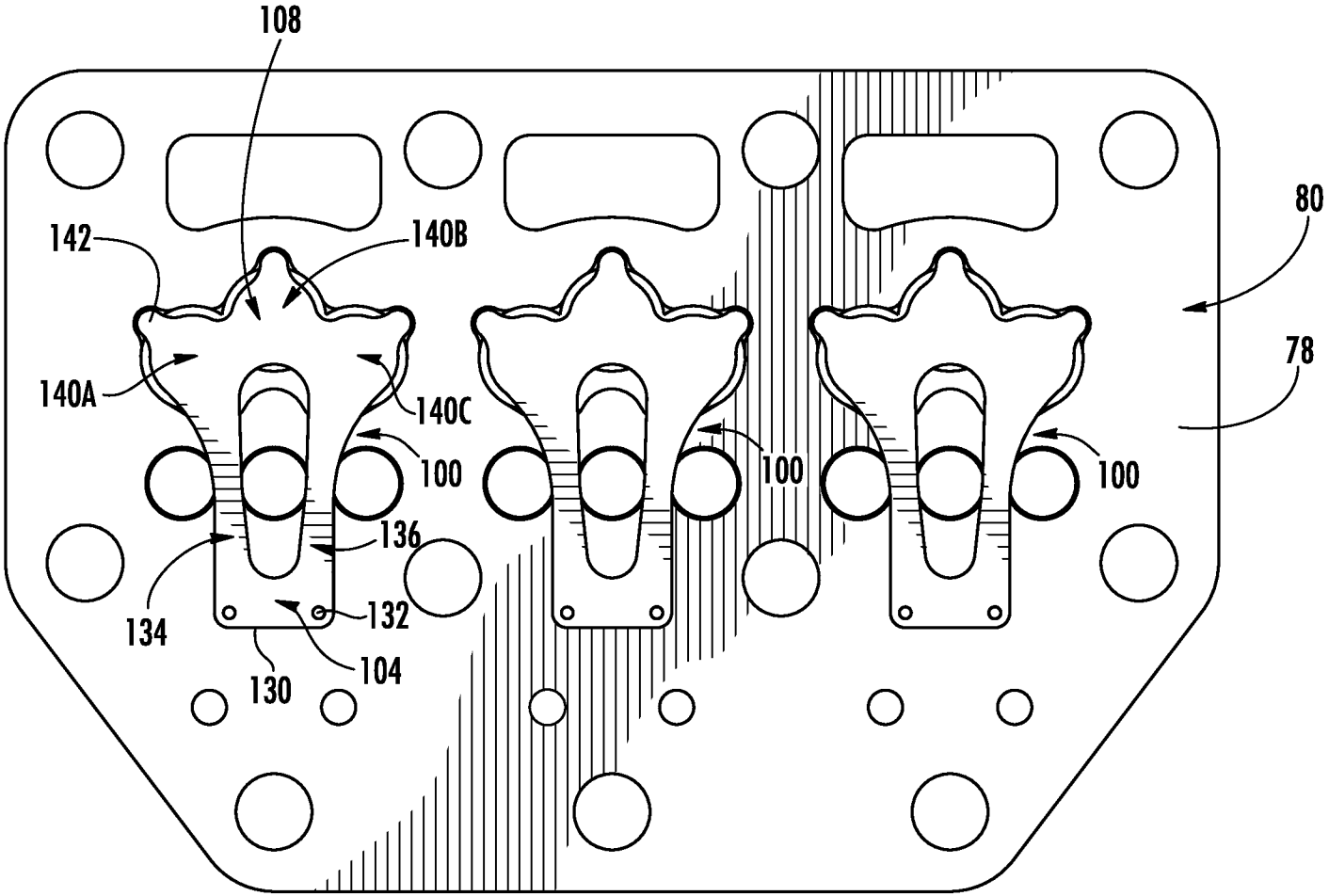
FIG. 4 is an underside view of a valve plate and suction valve reed assembly.

FIG. 4 is an underside view of the valve plate with just three suction valve reeds 100 mounted thereto. For ease of illustration, the discharge valve reeds and backers which would be seen below are not included. FIG. 4 is associated with an exemplary three-cylinder bank of cylinders. There may be one or more such banks of cylinders on a given compressor. Other numbers of cylinders are clearly possible.

Figure 5:
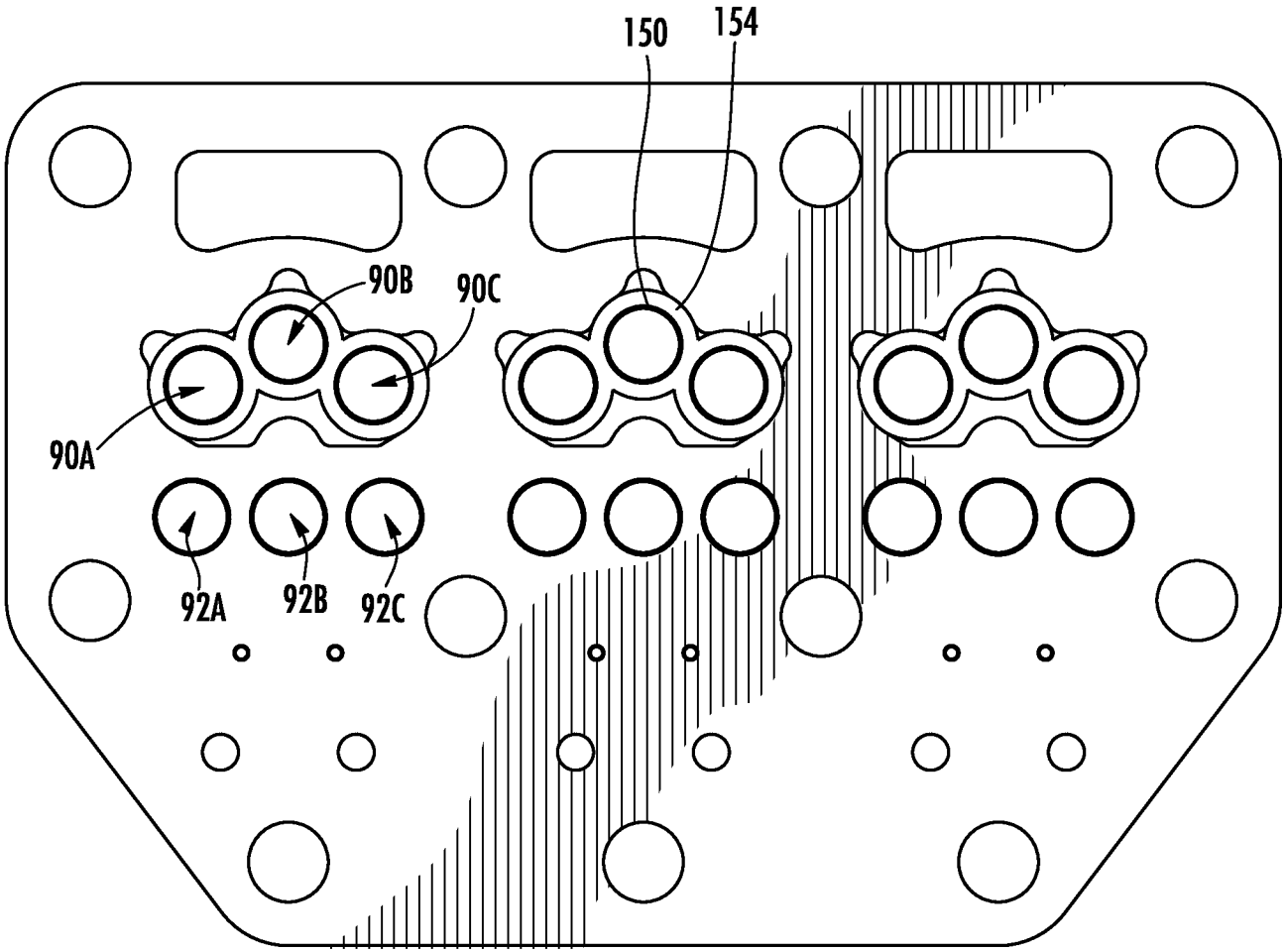
FIG. 5 is an underside view of the valve plate of FIG. 4.

FIG. 5 is a corresponding view of the plate alone. For each cylinder, there are three suction ports 90 (individually labeled as 90A, 90B, and 90C), and three discharge ports 92 (individually labeled as 92A, 92B, and 92C). FIG. 4 shows each reed 100 as blocking all three associated ports. The base 104 of the reed has an end/edge 130. The exemplary base 104 comprises a transverse web having a pair of apertures receiving dowel pins 132 for registering the reed with the plate. The pins 132 extend to corresponding apertures in the plate and may be press fitted flush to the reed. The exemplary reed has a pair of arms or branches 134 and 136 extending distally from the base 104 and respectively passing between adjacent discharge ports with 134 passing between 92A and 92B and 136 passing between 92B and 92C. These branches 134 and 136 rejoin at the distal end portion 108 which is formed with an exemplary three lobes 140A, 140B, and 140C (collectively and individually 140) respectively associated with the suction ports. Each of the lobes further comprises a generally circular main portion and a distally-projecting tip portion or tab 142. The exemplary lobe main portions merge with each other, with the main portions of the lobes 140A and 140C respectively merging with the branches 134 and 136 and the lobe 140B therebetween to join them.

FIG. 5 further shows each valve port as having an associated valve seat 150 circumscribing the associated port. The valve seat 150 has a rim which may be formed as an intact portion of the flat lower surface of the original plate (e.g., the plate 80 may be machined from plate stock having two surfaces corresponding to the ultimate upper and lower surfaces). Each of the valve seats is surrounded by a trepan 154. The exemplary trepans are vertically relieved/machined areas. The exemplary trepans are annular with each trepan just merging with the trepan of the adjacent suction port. A depth of the trepan corresponds to the seat height. FIG. 3 shows the port as circular, having an axis and a radius at the seat (along the seat inner surface).

FIG. 6 is a view of the cylinder of FIG. 3 in an intermediate position with a compressing condition of the valves shown solid and an expanding/suction condition shown broken. In the expanding condition, the underside of the suction reed 100 (position 100') at the tips 142 is bottomed against the bases of stop compartments in the cylinder wall. The trepan limits contact between the valve and the plate (and defines the seat). The closed discharge valve reed is shown in broken line as 102' while shown open in solid line.

Figure 7:
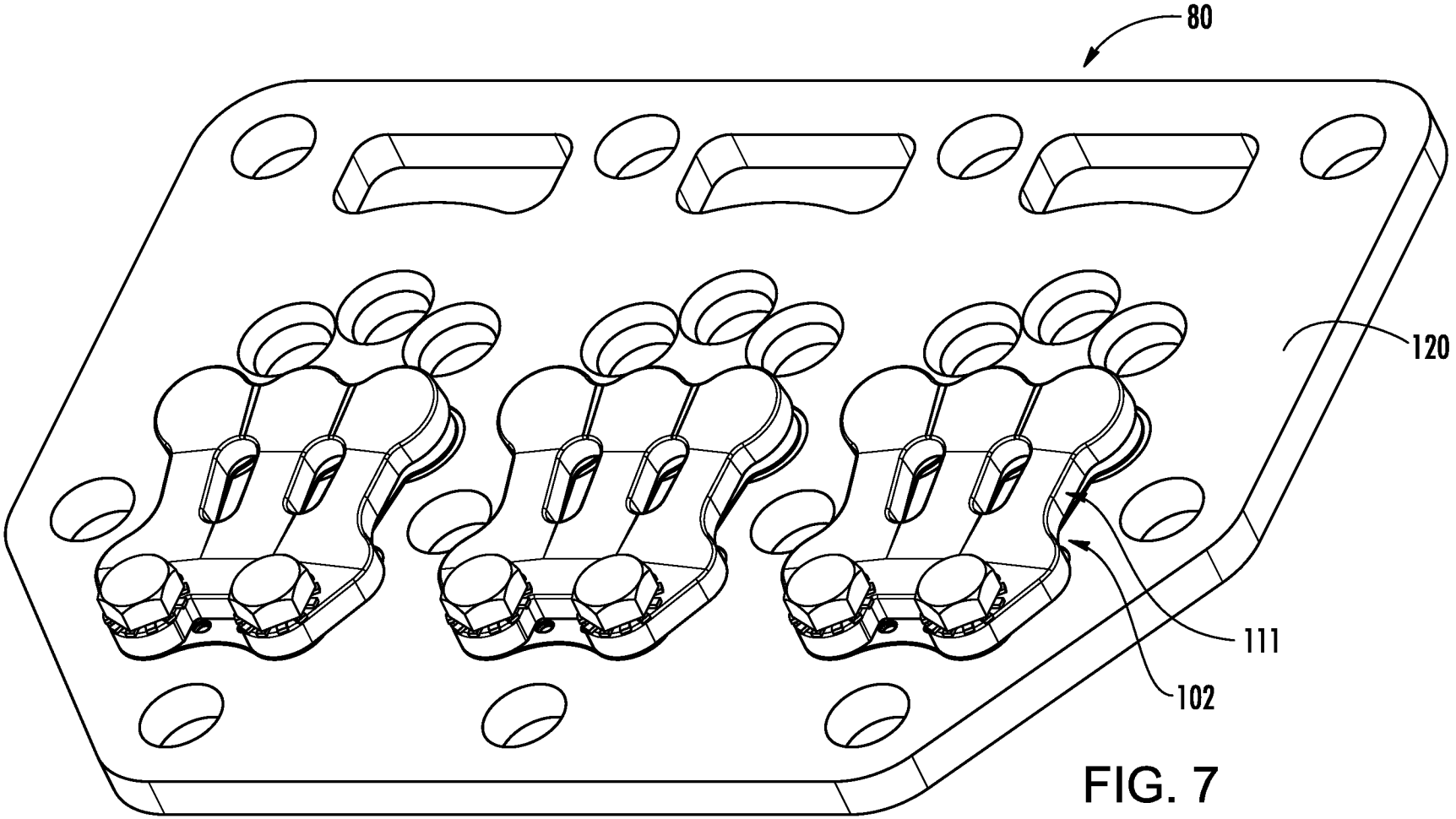
FIG. 7 is a view of the plate of FIG. 4 showing discharge valve reeds and backers assembled thereto.
Figure 8:
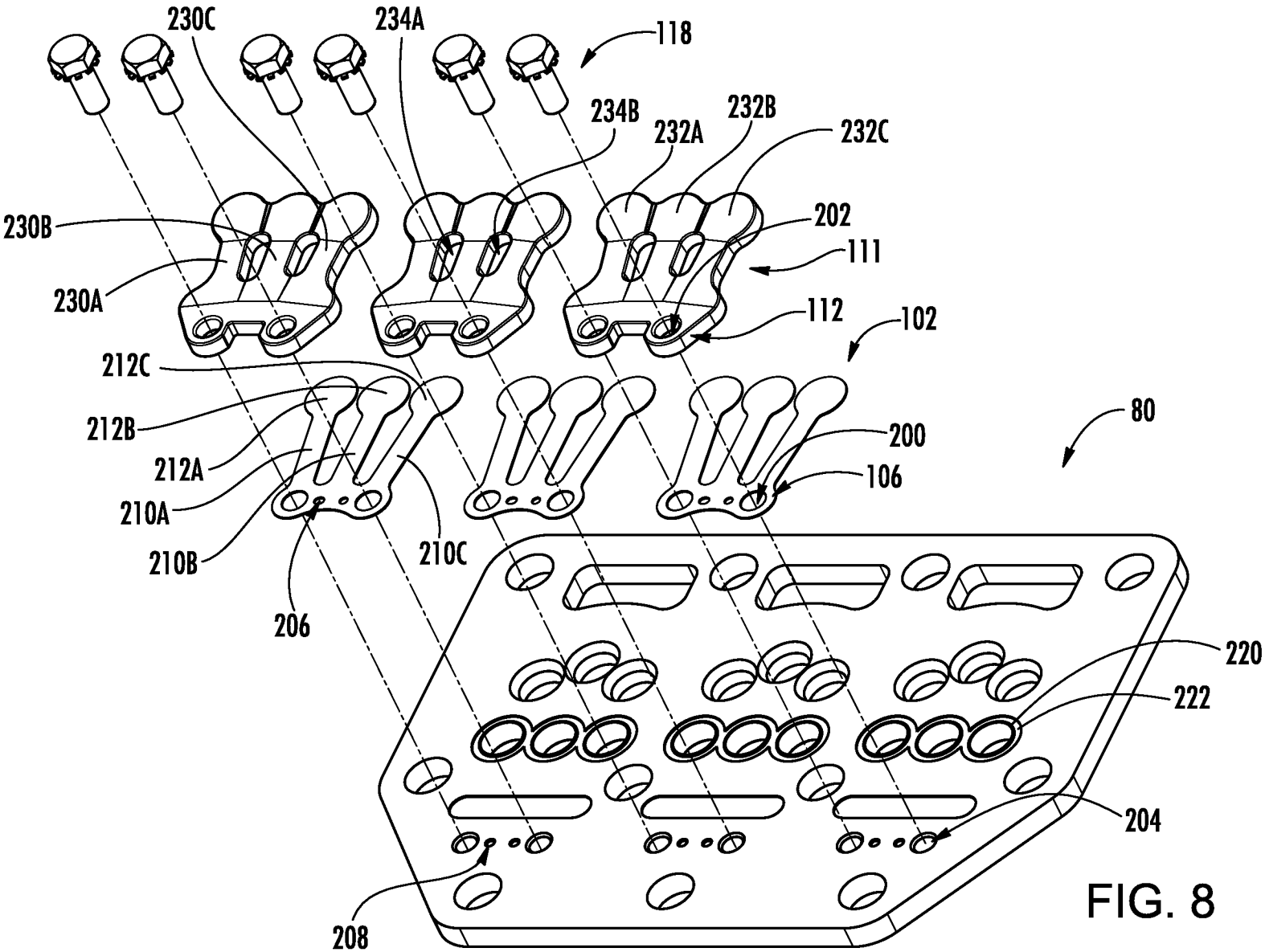
FIG. 8 is a partially exploded top view of the plate of FIG. 7.

FIG. 7 shows three discharge reeds 102 and associated backers 111 arranged generally similarly to the suction reeds on the opposite face of the valve plate 80. The exploded view of FIG. 8 shows further details of the reeds and backers. The exemplary reeds 102 (FIG. 8) have, along their base portion 106, a pair of holes 200 for accommodating the shafts of the bolts 118 or other fastener. The exemplary base portion 112 of the backer 111 may have similarly dimensioned and positioned holes 202. The exemplary valve plate 80 also has similar holes 204 which, in the exemplary embodiment, are threaded to receive the threaded shafts of the bolts 118.

As is discussed further below, the exemplary reeds 102 also include a pair of laterally inboard smaller holes 206 complementary to holes 208 in the plate for receiving pins (not shown) which may be similar to the dowel pins 132 of FIG. 4. In the exemplary implementation, there are no such dowel pins but the holes 208 and 206 are vestiges of a baseline system using the same plate and reeds but different backers.

FIG. 8 further shows each of the discharge reeds 102 as including three arms (which may alternatively be characterized as branches or trunks) 210A, 210B, and 210C (collectively 210) extending distally from the base portion 106. Each of these arms extend to an associated terminal lobe 212A, 212B, and 212C (e.g., essentially formed as circular in planform merging with the distal ends of the associated arm 210). The exemplary arms 210 have a pair of lateral edges generally parallel to each other. The exemplary arms 210 slightly diverge angularly from each other. FIG. 8 also shows the seats 220 of the discharge ports and surrounding trepans 222. The exemplary trepans are contiguous with each other. In the exemplary plate, each cylinder has three discharge ports in a linear array. However, other numbers may be possible as is discussed below. In their closed conditions, the reed underside along each of the lobes seats to the seat 220 of the associated port.

The exemplary backer 111 also includes three arms (alternatively designated branches or trunks) 230A, 230B, and 230C (collectively 230) respectively extending out from the base portion 112 to associated terminal lobes 232A, 232B, 232C (collectively 232). In this implementation, each lobe 232 is contiguous with the adjacent lobe(s) so that a pair of apertures 234A and 234B are formed on opposite sides of the central branch 230B respectively between the central branch and the associated lateral/outboard branch 230A or 230C.

Figure 9:
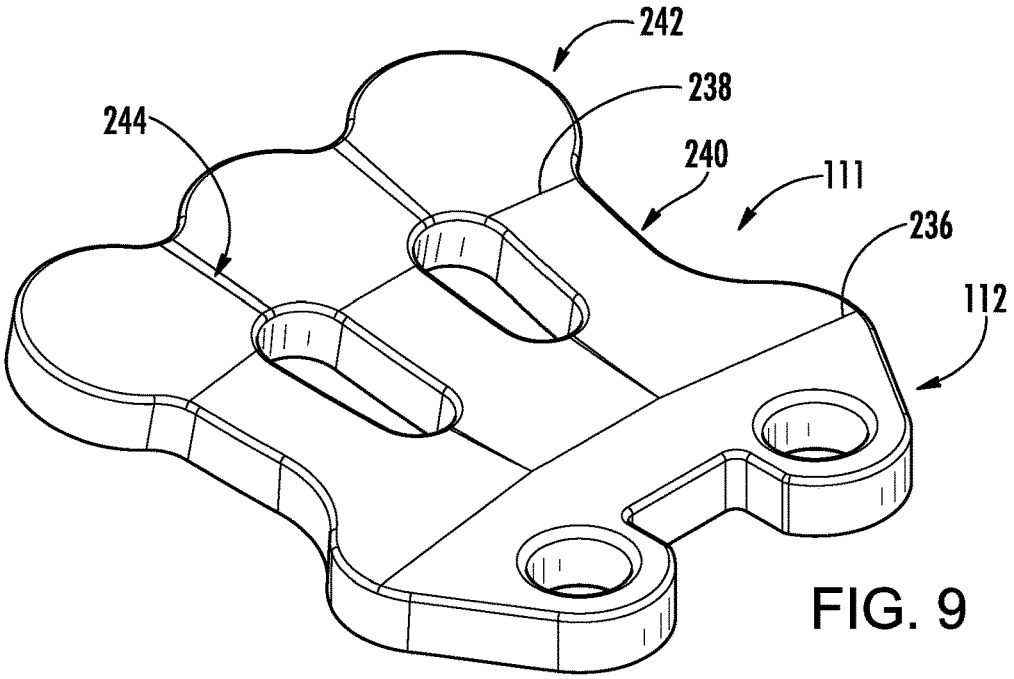
FIG. 9 is a view of a backer for assembly to the plate.

As is discussed further below, FIGS. 9-13 show further details of the exemplary backer 111. The exemplary backers are formed from five-gage (0.2092 inch (5.3 mm)) cold rolled steel (CRS), more broadly, 4-7 mm CRS. FIG. 9 shows schematically represented bend features (schematically shown as single lines along the surface) 236 and 238 defining approximate boundaries of bending. The bend line 236 generally is formed along the boundary of a central portion 240 of the backer along the arms and the base portion 212. Similarly, the bend line 238 is generally along a junction between the central portion 240 and a distal portion 242 formed by the lobes. This bending of the trunk allows the central and distal portions to curve up and away from the plate upper surface (e.g., as is shown in FIG. 3). FIG. 9 also shows a pair of bends 244 which bend the lateral arms and lobes slightly upward from the central arm and lobe (see FIGS. 12 and 13). In this example, there is a relatively continuous curvature change along the arms with the proximal and distal portions being flat in order to respectively mount the backer and provide a flat surface for the reed lobes to contact (so that the reed lobes do not deform and, thereby, have difficulty sealing). For reference purposes, this curvature will be identified as transverse because the associated axes of curvature are transverse with the trunk underside thus being transversely convex along at least a portion and the trunk upper surface being correspondingly concave. An exemplary total static/relaxed angular departure of the distal portion relative to the proximal/mounting portion by the bending of the arms/trunks is 5-15°, more narrowly 8-11°.

Figure 10:
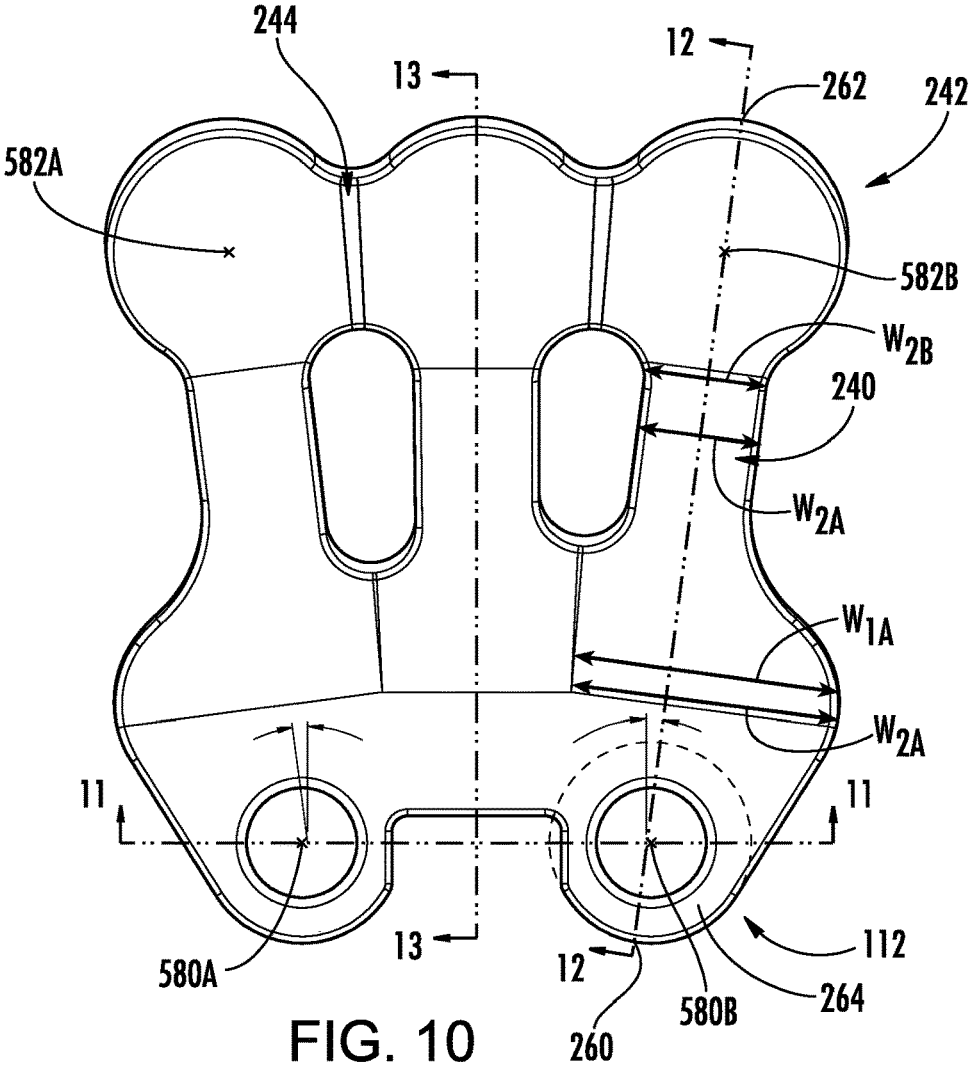
FIG. 10 is a plan view of the backer.
Figure 11:
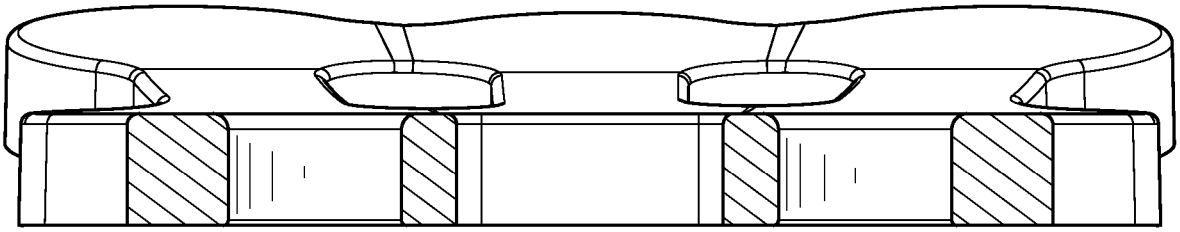
FIG. 11 is a sectional view of the backer of FIG. 10, taken along line 11-11.
Figure 12:
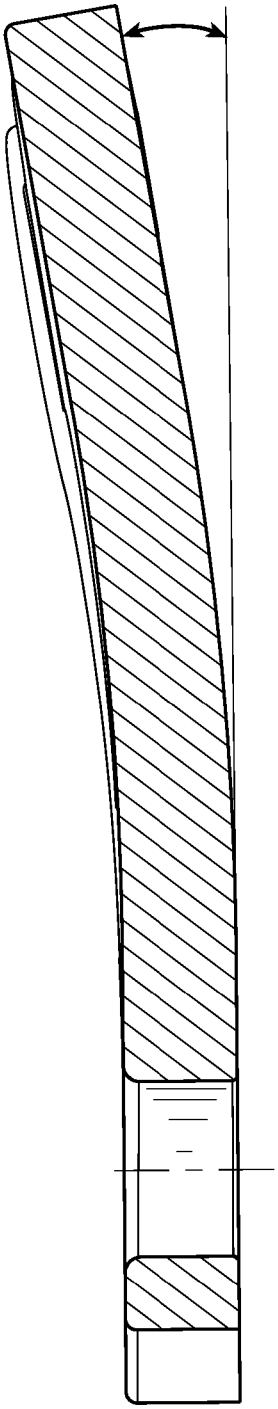
FIG. 12 is a sectional view of the backer of FIG. 10, taken along line 12-12.
Figure 13:
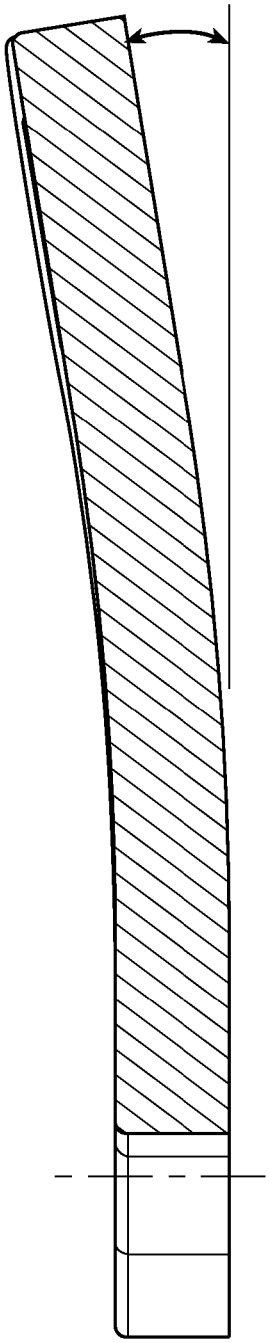
FIG. 13 is a sectional view of the backer of FIG. 10, taken along line 13-13.

FIG. 10 shows the central vertical axes (centerlines) 580A and 580B of the mounting holes. The associated outboard arms are nearly radially oriented relative to these axes with the centerplanes of the straight portions of the arms (e.g., cut plane 12-12) nearly along this line. As a frame of reference, FIG. 10 also shows several other features. Lobe centers 582 may be geometric centers of a principal arc of the lobe perimeter (e.g., extending intact from approximately 10:30 to approximately 5:00 for the right hand lobe in FIG. 10) or may correspond to a location that lines up with where a center of the reed lobe contacts the underside of the backer when flexed (that reed lobe center being defined by a location on the reed which aligns with the center of the associated port when the reed is closed). In this example, it is seen that the cut plane 12-12 which is longitudinally centered along the straight part of the arm/trunk essentially intersects the center 582B and nearly intersects the axis/center 580B. Measurements of reference locations along the arm/trunk may be made along this line/plane or along a line/plane between the centers (or along other lines/planes as discussed further below). However, in this example, the departures associated with the plane 12-12 not intersecting the hole center are so slight as to not make a difference and the locations may be projected normal to such cut plane for making relative measurements.

FIG. 10 shows a reference trunk width $W_{1A}$ marked at a location 30% of a span from the center 580B to the center 582B. FIG. 10 similarly shows a width $W_{2A}$ marked at a location 30% of the span in the opposite direction (from the center 582B toward the center 580B). These relative locations may serve as reference points for measuring the relative greater width near the base portion of the backer than near the distal portion of the backer (discussed numerically below). If the width near the distal portion is unchanged relative to a baseline from which the backer is reengineered, this relative difference will be the same as the relative increase near the proximal portion. A further reference location for this measurement would be 35% of span from either center.

As another frame of reference, FIG. 10 also shows a proximal end 260 and a distal end 262 of the backer. In this example, these are marked along the plane 12-12. If alternatively marked as the uppermost and lowermost extreme viewed in the drawing, these will only be shifted slightly (slightly counterclockwise for 260 and slightly counterclockwise for 262) and will not substantially affect relative measurements using these as reference points instead of the centers. In a similar fashion, FIG. 10 also includes proximal and distal widths $W_{2A}$ and $W_{2B}$ respectively measured at 35% of the spans between these two reference locations 260 and 262 from the proximal end and the distal end, respectively. Again, the difference between $W_{2A}$ and $W_{2B}$ may provide an indication of the relatively greater proximal width and/or width increase in a reengineering. A further alternate location for this measurement would be at 40% of span from either end.

Figure 15:
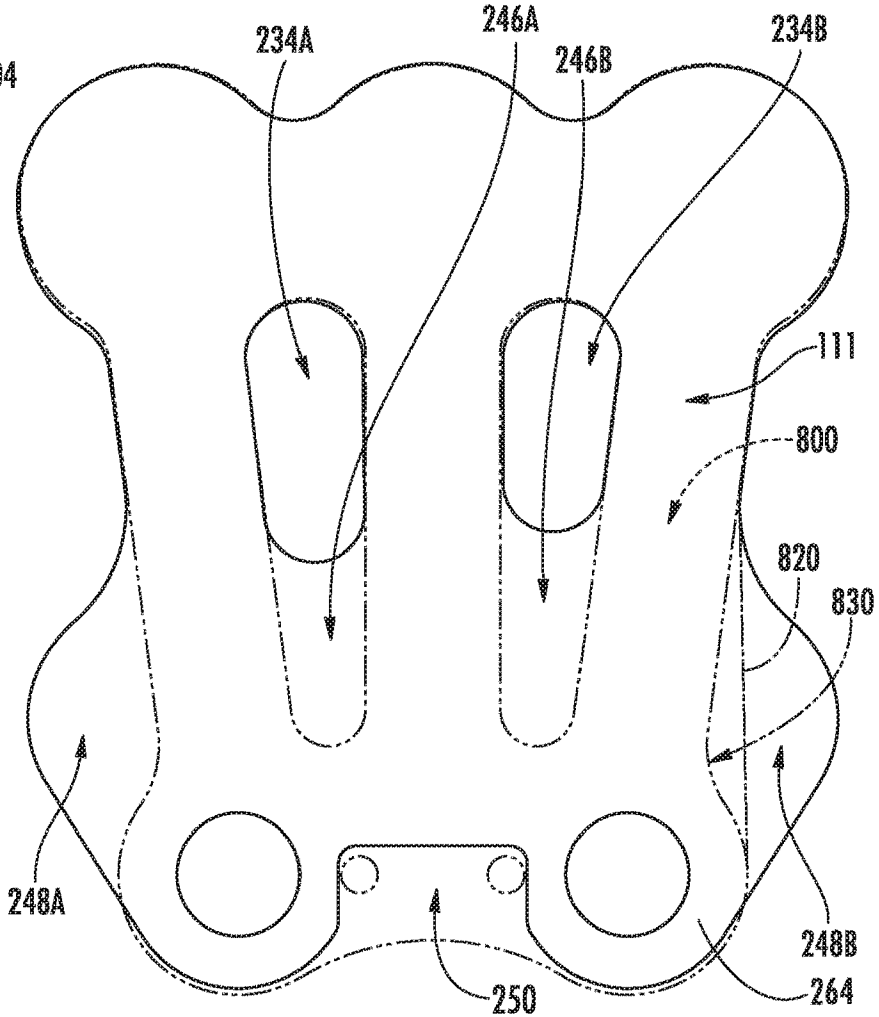
FIG. 15 is a superposed plan view of the backers of FIG. 10 (solid line) and FIG. 14 (broken line with one long line and two short lines).
Figure 14:
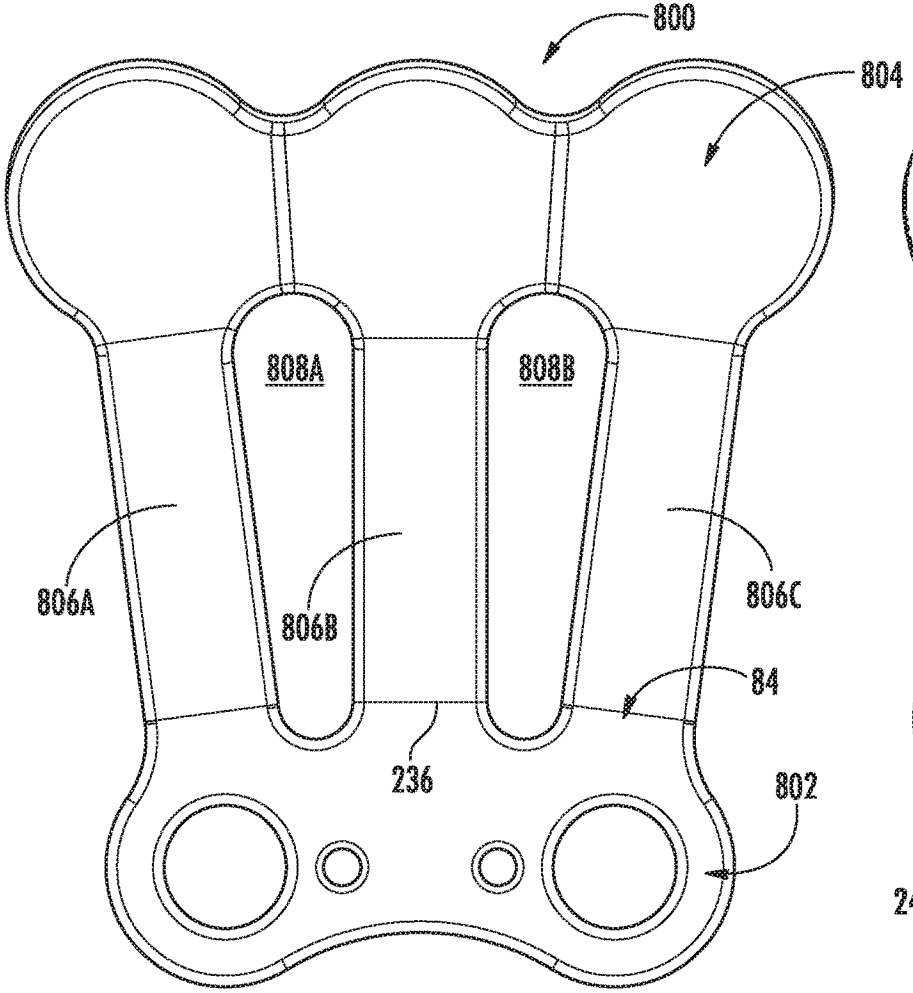
FIG. 14 (PRIOR ART)
FIG. 14 is a plan view of a prior art backer.

FIG. 14 shows a baseline backer 800 having a base portion 802, a contiguous lobe distal portion 804, and arms 806A, 806B, and 806C joining the base portion to the distal portion and defining a pair of holes 808A and 808B in similar fashion to that discussed above. This exemplary baseline may be otherwise similar to the backer 111 with the exception of the nature of the arms and the inter-arm holes. Thus, thickness and material may be preserved. In alternative structures, there may be changes to these. An exemplary small change would be up to 5% thickness change. FIG. 15 shows the two backers superposed and highlighting differences in planform. The exemplary arms of the baseline are of generally uniform width over a longer span than the arms of the backer 111. In this example, the arms of the backer 111 are substantially widened along essentially a proximal half thereof and sufficiently to merge and reduce the inter-arm aperture length by a substantial amount. This essentially adds material at locations 246A and 246B to reduce the inter-arm aperture holes (shifting their proximal ends distally). The exemplary widening of arm proximal portions also adds material at outboard locations 248A and 248B at proximal portions of the outboard arms to create wing-like structures. As is shown in FIG. 15, these wing-like structures have substantial protrusion (even beyond a hypothetical boundary 820 formed by thickening the proximal portion of the baseline arm by essentially maximally decreasing the curvature (increasing the radius of curvature) of a junction 830 between the proximal portion and the arm along the lateral side of the arm. FIG. 15 shows a width of this added material in the wing 248B as being in excess of that merely associated with the curvature reduction 820 (e.g., by more than twice the width associated with the curvature reduction at 820).

FIG. 10, in broken lines, also shows the projection of a circumference of a circular region 264 of the base/mounting portion. It is seen that the widening adds substantial material laterally beyond the radius of this portion. For example, a maximum distance along the added portion 248A or 248B of FIG. 15 away from the cut plane 12-12 (or plane/line between the axes 580B and 582B may be at least 20% greater than a radius of the portion 264 (more particularly, at least 30% greater or at least 50% greater).

The revised backer 111 may have advantageous performance when used with certain high pressure refrigerant relative to the baseline backer 800. For example, high pressure R410a refrigerant is associated with greater stress on the backer than with R22 refrigerant. The source of loading on the backer is the high velocity jet(s) of refrigerant coming out of the discharge port(s); the density of the refrigerant is especially high in a flooded start situation where the jet of refrigerant contains a high percentage of liquid. High density refrigerant jets impact on the backer head/lobe(s) displacing the backer and overstressing the backer in the trunk root area 840 (FIG. 14 near the bend line 236). The bending stress is particularly significant near the trunk root at the bend line 236 due to the length of the lever arm from the lobe center to that location. This is more significant with high pressure refrigerant like R410a than with R22 because such refrigerant will have greater density at discharge and therefore will apply greater force to the backer. High pressure refrigerant for this purpose may be treated as one whose "vapor phase pressure" exceeds one of the following: 17 psia (117 kPa) for saturated temp of −40 F (−40 C); 30 psia (207 kPa) for saturated temp of −15 F (−26 C); 60 psia (414 kPa) for saturated temp of 20 F (−7 C); 105 psia (724 kPa) for saturated temp of 50 F (10 C); 220 psia (1.52 MPa) for saturated temp of 100 F (38 C); and/or 410 psia (2.83 MPa) for saturated temp of 150 F (66 C). Other high pressure refrigerants are R23, R32, R125, R143a, R404a, R407C, R744, and R170.

To better handle such stresses, the trunk cross sections are increased (widened for a generally constant thickness/height associated with forming from plate stock). In particular, they are widened nearer the base/mounting portion 112 than nearer the lobes/distal portion 242. Between the trunks, this is associated with a shortening of the inter-lobe holes (in particular by shifting the proximal ends outward). At outboard sides of the trunks (of the two outer trunks in the three-trunk example) this is associated with a widening that may create a mere taper (e.g., to broken line 820) or, in the illustrated example, form a lateral wing or protrusion 248A, 248B.

This may alternatively be characterized as forming an at least half (for the lateral side arms) bulbous or barrel-like planform with a convexity shifted away from the convexity of the portion 264 of FIG. 10.

Such widening reduced the backer mechanical stresses at the root portion of the trunks.

Figure 16:
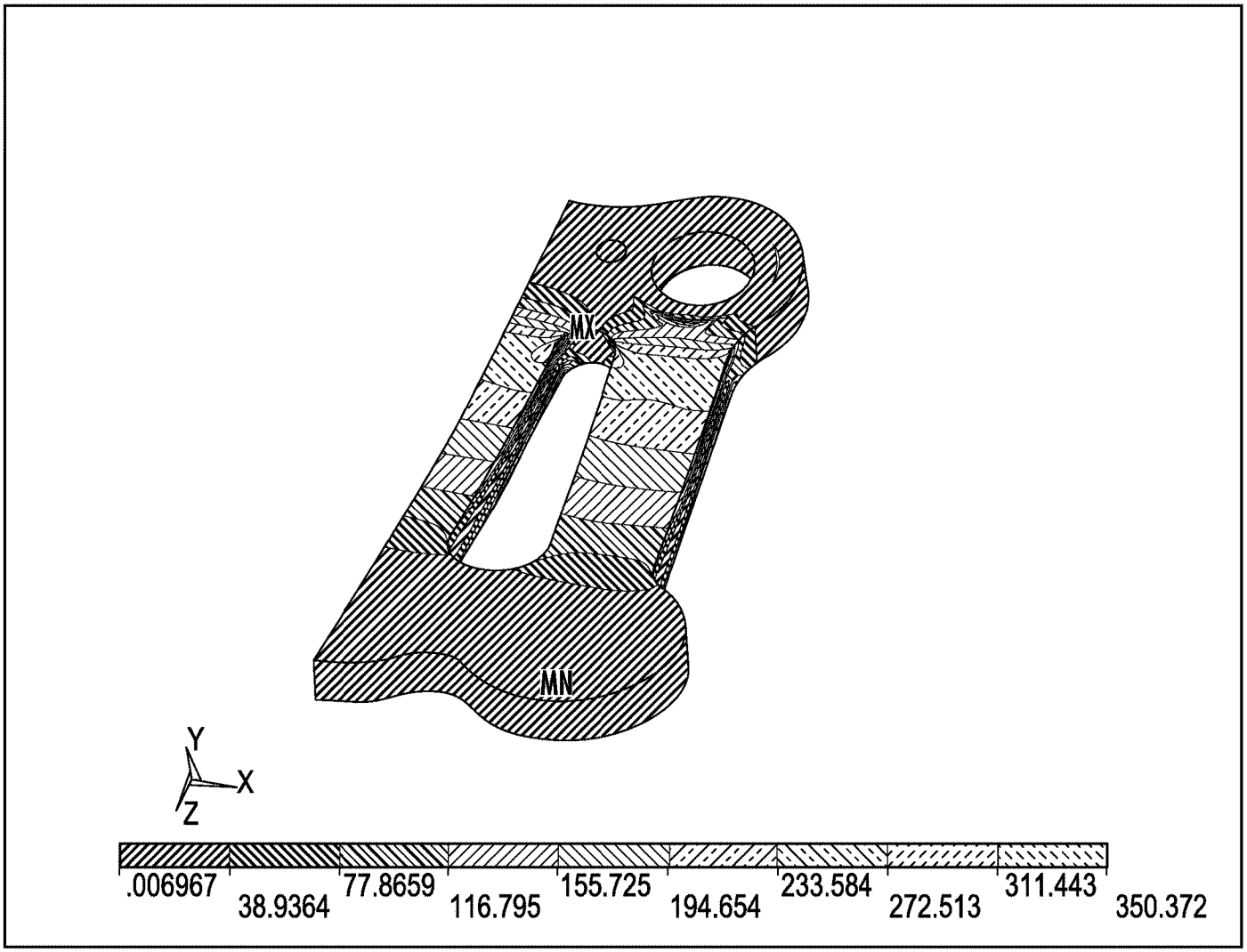
FIG. 16 (PRIOR ART)
FIG. 16 is a von Mises stress map for the backer of FIG. 14.
Figure 17:
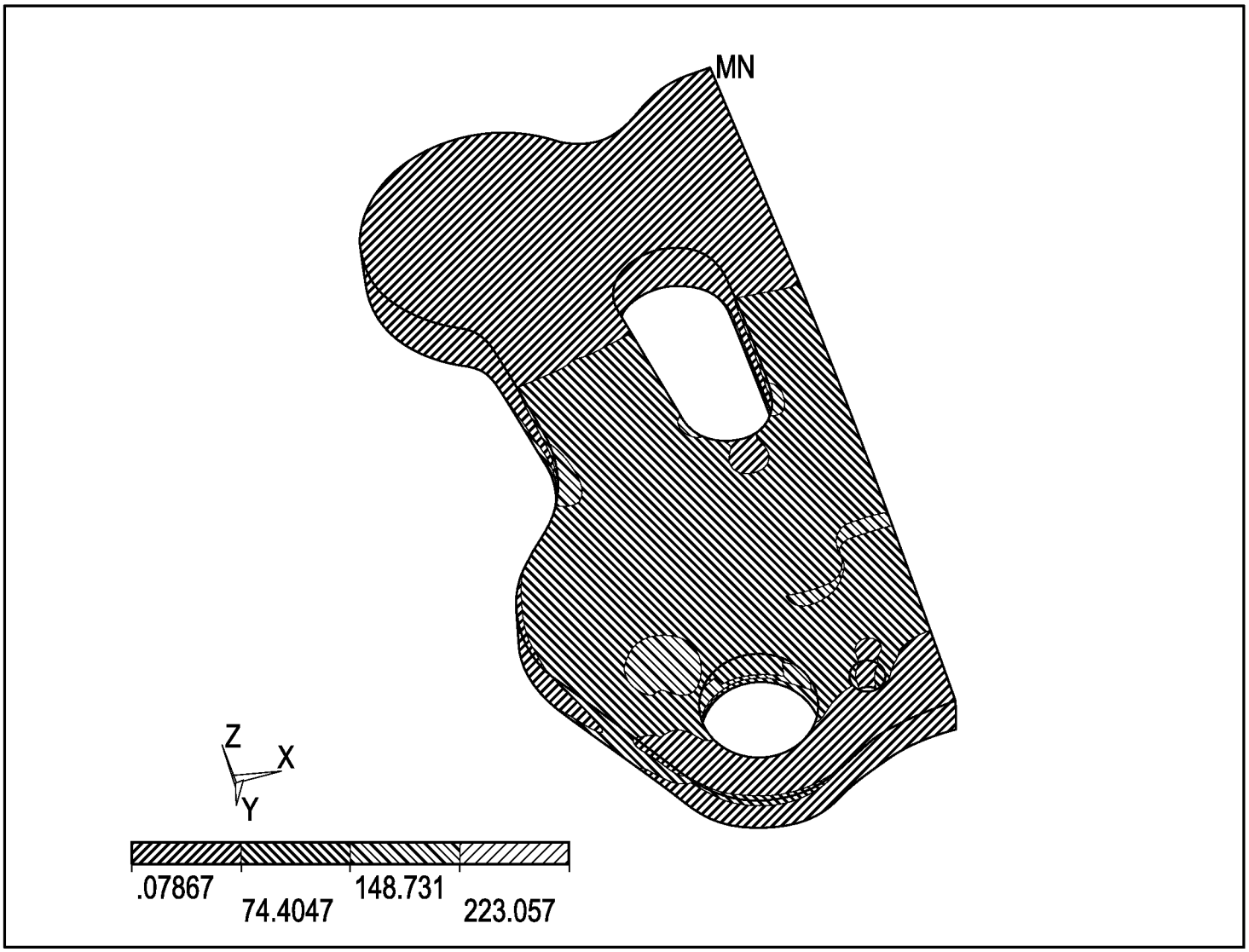
FIG. 17 is a von Mises stress map for the backer of FIG. 10.
Figure 20:
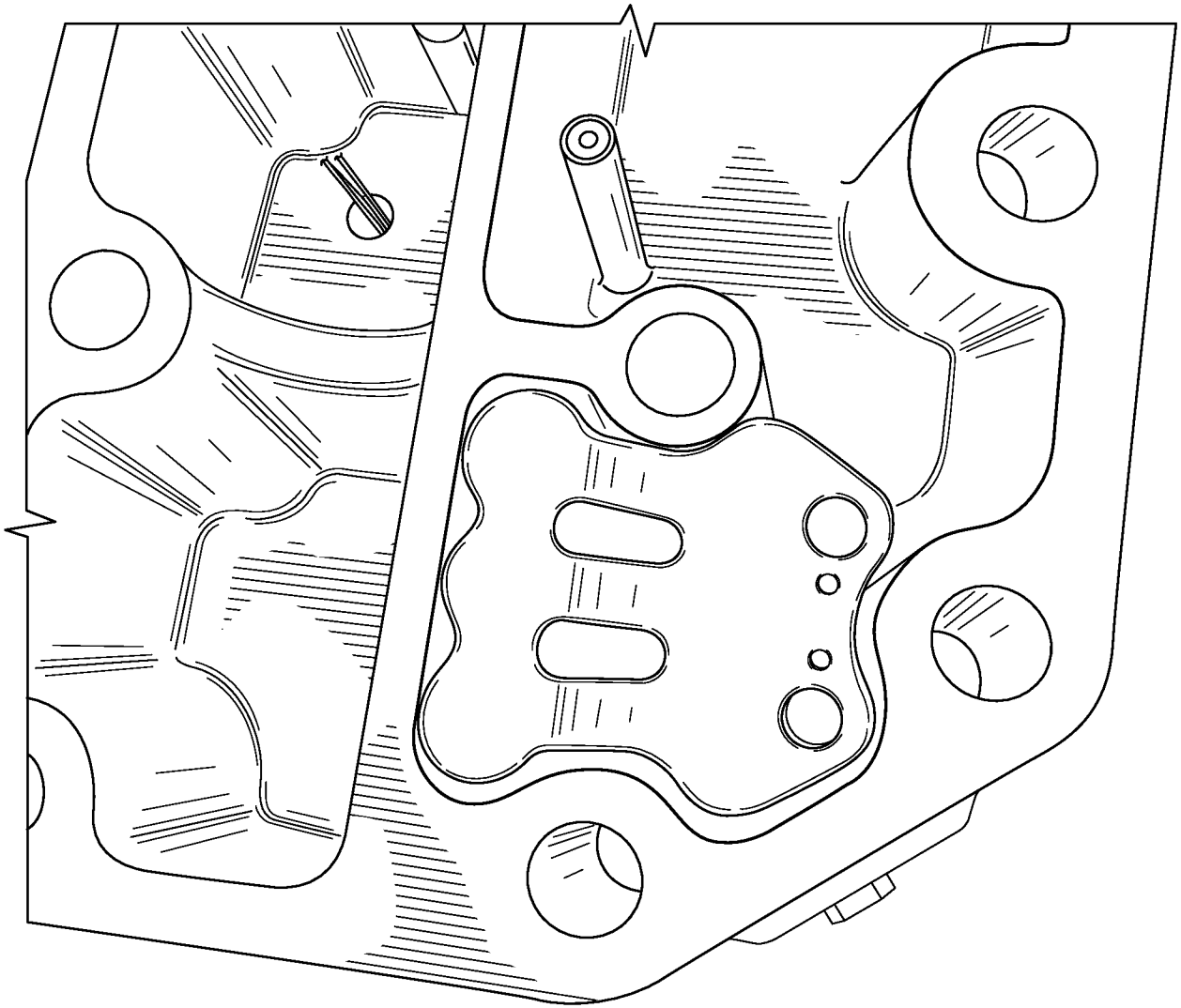
FIG. 20 is a view of an alternate backer nested (loosely prior to final positioning/securing) in a head casting framework.

The exemplary widening increases cross-sectional area (even at a given thickness) by an exemplary amount of at least 15%, more particularly, at least 20% or at least 30% or at least 50% and an exemplary 20-150% (more narrowly, 30-120% or 50-80%). Because the stress is proportional to the cross-sectional area, an exemplary stress reduction is at least 15%, more particularly at least 20% or at least 30% or at least 50%. Finite element analysis performed on the baseline backer 800 and a revised backer is reflected in the von Mises stress map of FIGS. 16 and 17. These confirmed at least 20% reduction in peak stress (FIG. 17) relative to the baseline (FIG. 16) and indicated that the stress is now relatively equally distributed throughout the lower highly stressed part of the backer. The exemplary plot of FIG. 17 is of a slightly different backer than 111, retaining the pin-mounting holes of the baseline and having equal-length inter-arm holes. FIG. 20 shows such a backer hand-positioned in the adjacent case member which sits atop the valve plate. FIG. 20 also shows how the limits of the wings 248A, 248B may be influenced by available case lateral space.

In the exemplary implementation, discharge reed pins are eliminated and the reed is positioned solely by the mounting bolts. Accordingly, an adjacent central portion of the backer base portion may be relieved to form a recess 250 (FIG. 15) and save material weight. The exemplary implementation also features unequal length inter-arm holes 234A and 234B. In the exemplary implementation, the exemplary holes 234A are at least about 10% longer than the holes 234B (e.g., 10-20%) than the holes 234B. This is one example of an asymmetry which provides a visual indicator quickly informing an observer (whether human or machine vision) which face of the backer the observer is seeing. This allows quick verification that the backer is being installed in the correct orientation. Myriad other asymmetries could alternatively provide this function as could alphanumeric or pictorial indicia (e.g., stamped or engraved legends).

Figure 19:
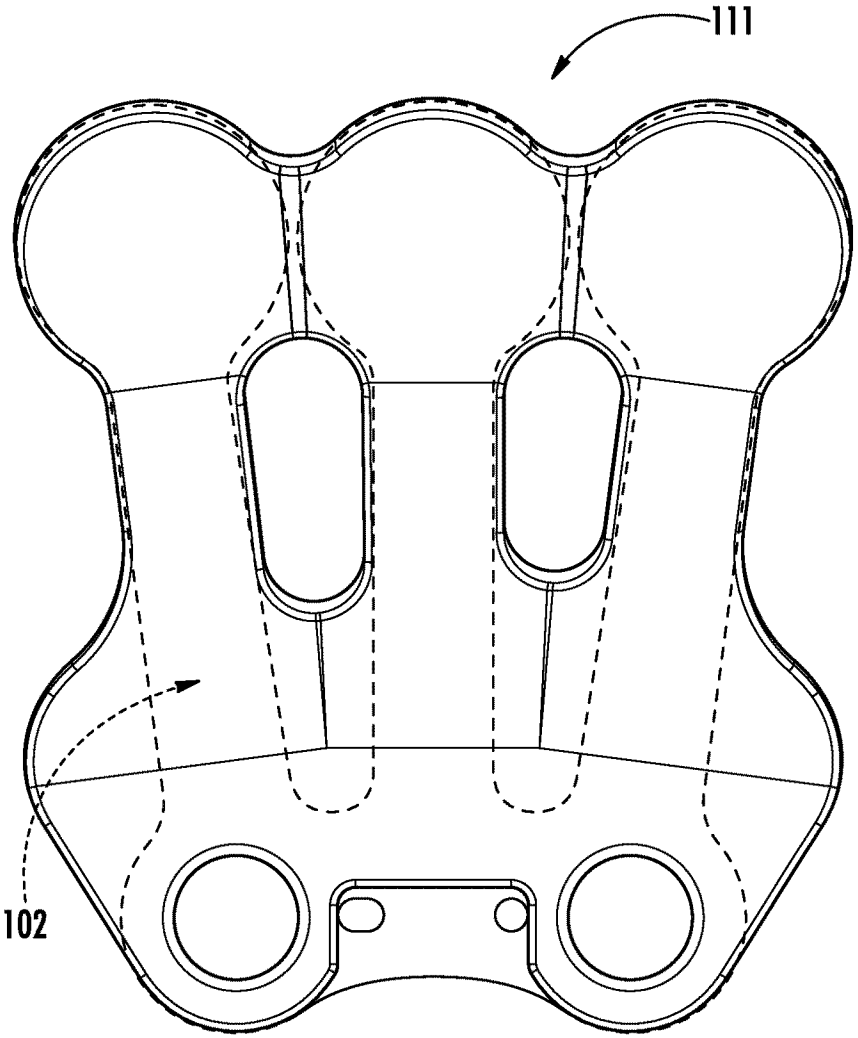
FIG. 19 is a superposed view of the backer of FIG. 10 and a reed.
Figure 18:
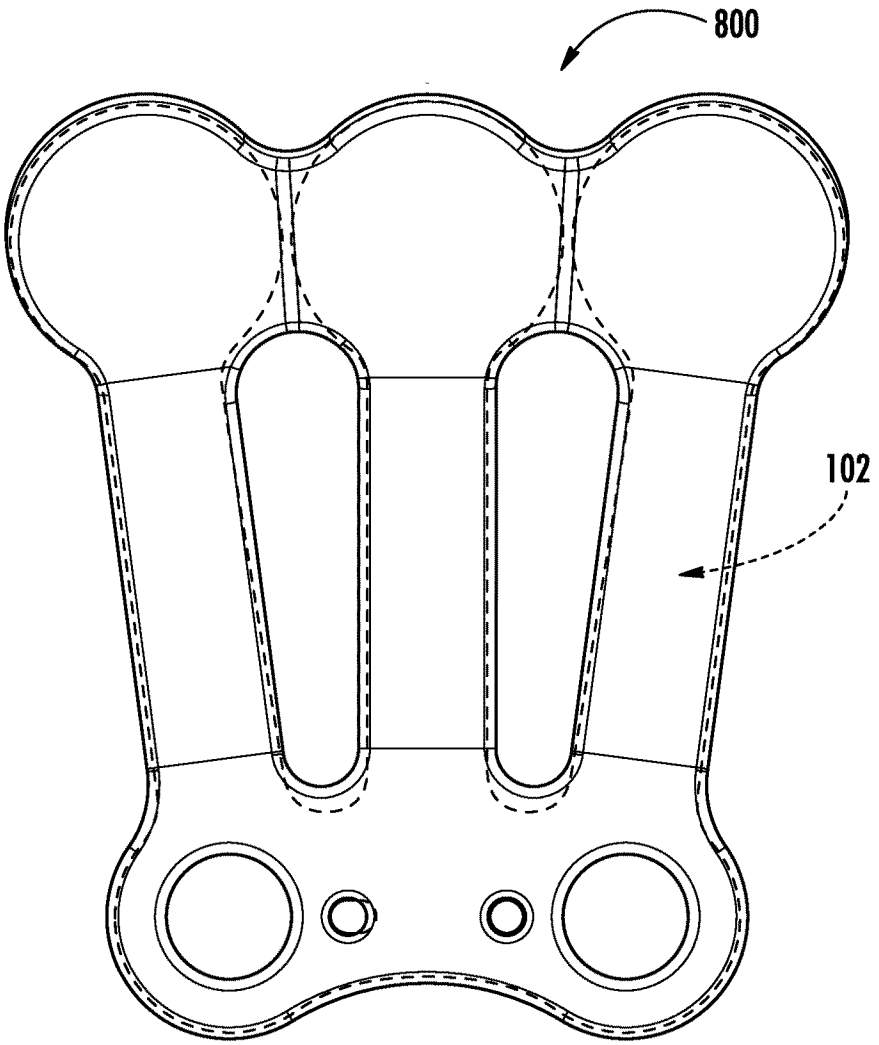
FIG. 18 (PRIOR ART)
FIG. 18 is a superposed plan view of the backer of FIG. 14 and a reed.

FIGS. 18 and 19 also show relationship of the planform of the baseline reed (broken lines) to the baseline backer 800 and revised backer 111. The planforms of the reed and baseline backer may be nearly identical (e.g., differing most notably in the reed's lack of contiguous lobes). The inter-arm holes may have generally the same planform and length (if one implies an end to the reed inter-arm hole near the distal ends of the arms where the arms join the lobes). Thus, the geometrical relationships between the planform of the backer 111 and the baseline reed may be similar to the geometrical relationships between the planform of the backer 111 and the baseline backer 800. Thus, assuming the reed is preserved in planform (e.g., widening the reed planform complementarily to the widened planform of the backer trunks would potentially affect reed performance by making the reed less flexible), the relationship between the reed planform and the backer is fundamentally changed in such embodiments as may continue to use such a baseline reed. This difference in planform may be approximated by the aforementioned protrusion of the wing portions 248A and 248B and recessing of the inter-arm holes.

Figure 21:
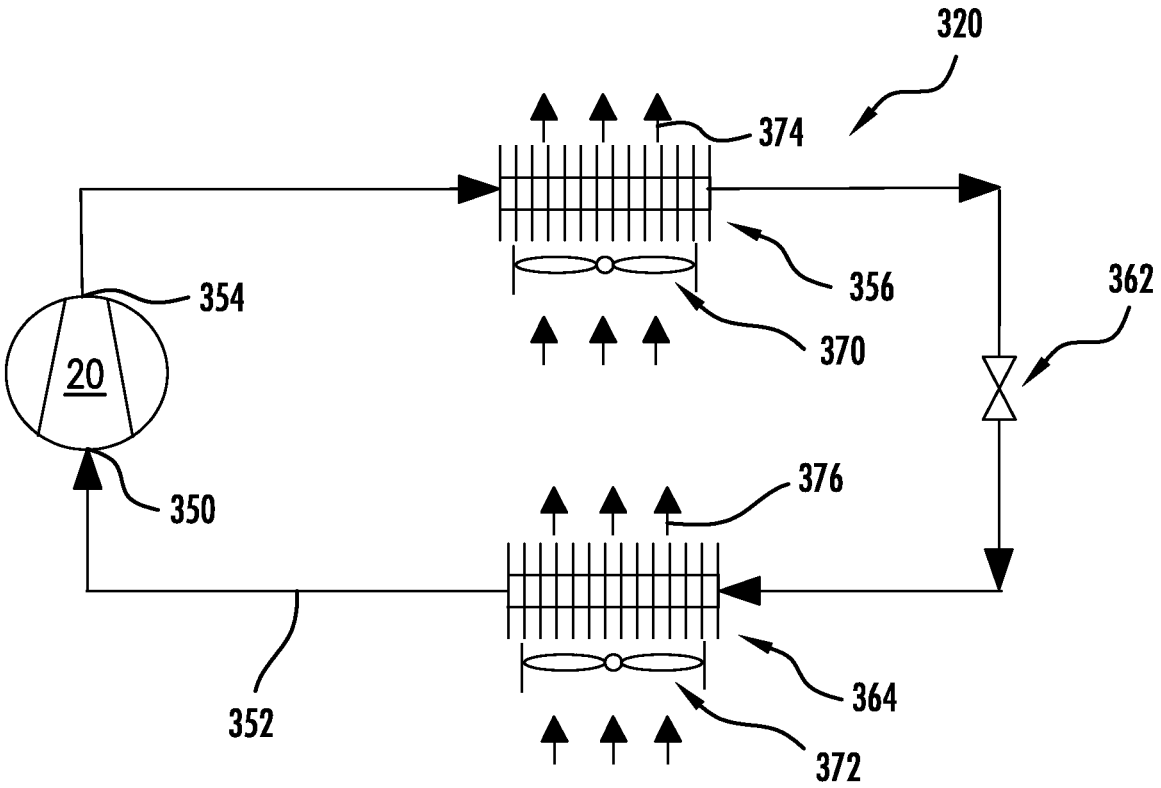
FIG. 21 is a schematic view of a refrigeration system.

FIG. 21 shows an exemplary refrigeration system 320 including the compressor 20. The system 320 includes a system suction location/condition 350 at the suction port 26. A refrigerant primary flowpath 352 proceeds downstream from the suction location/condition 350 through the compressor cylinders in parallel to be discharged from a discharge location/condition 354 at the discharge port 28. The primary flowpath 352 proceeds downstream through the inlet of a first heat exchanger (gas cooler/condenser) 356 to exit the outlet of the gas cooler/condenser. The primary flowpath 352 then proceeds downstream through an expansion device 362. The primary flowpath 352 then proceeds downstream through a second heat exchanger (evaporator) 364 to return to the suction condition/location 350.

In a normal operating condition, a recirculating flow of refrigerant passes along the primary flowpath 352, being compressed in the cylinders. The compressed refrigerant is cooled in the gas cooler/condenser 356, expanded in the expansion device 362, and then heated in the evaporator 364. In an exemplary implementation, the gas cooler/condenser 356 and evaporator 364 are refrigerant-air heat exchangers with associated fan (370; 372)-forced airflows (374; 376). The evaporator 364 may be in the refrigerated space or its airflow may pass through the refrigerated space. Similarly, the gas cooler/condenser 356 or its airflow may be external to the refrigerated space.

Additional system components and further system variations are possible (e.g., multi-zone/evaporator configurations, economized configurations, and the like). Exemplary systems include refrigerated transport units and fixed commercial refrigeration systems.

Figure 22:
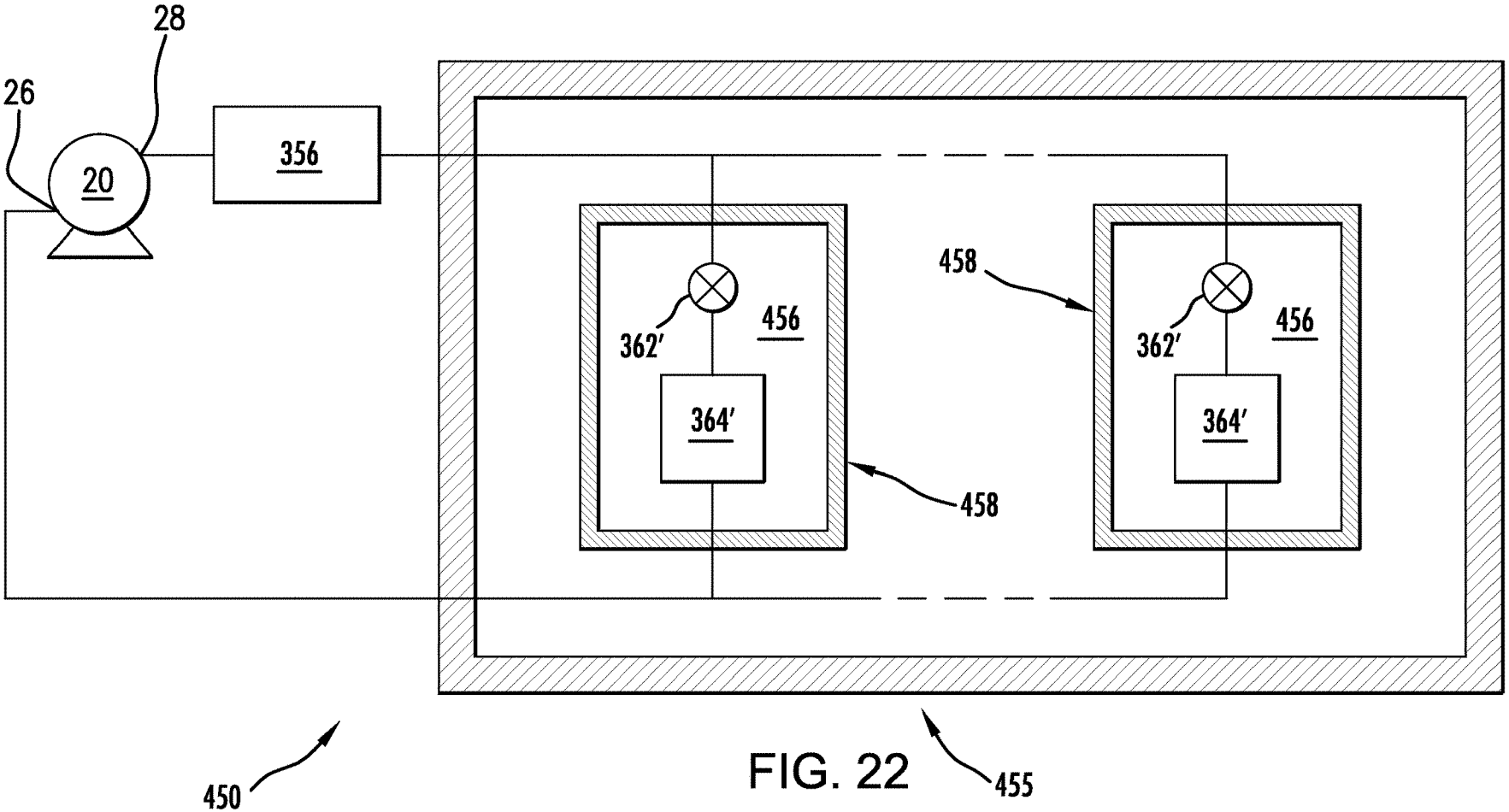
FIG. 22 is a schematic view of a fixed commercial refrigeration system.

An exemplary fixed commercial refrigeration system 450 (FIG. 22) includes one or more central compressors 20 and heat rejection heat exchangers 356 (e.g., rack-mounted outside/on a building 455) commonly serving multiple refrigerated spaces 456 (e.g., of retail display cabinets 458 in the building). Each such refrigerated space may have its own heat absorption heat exchanger 364' and expansion device 362' (or there may be a common expansion device). Other rack-mount situations include building heating, ventilation and air conditioning (HVAC).

Figure 24:
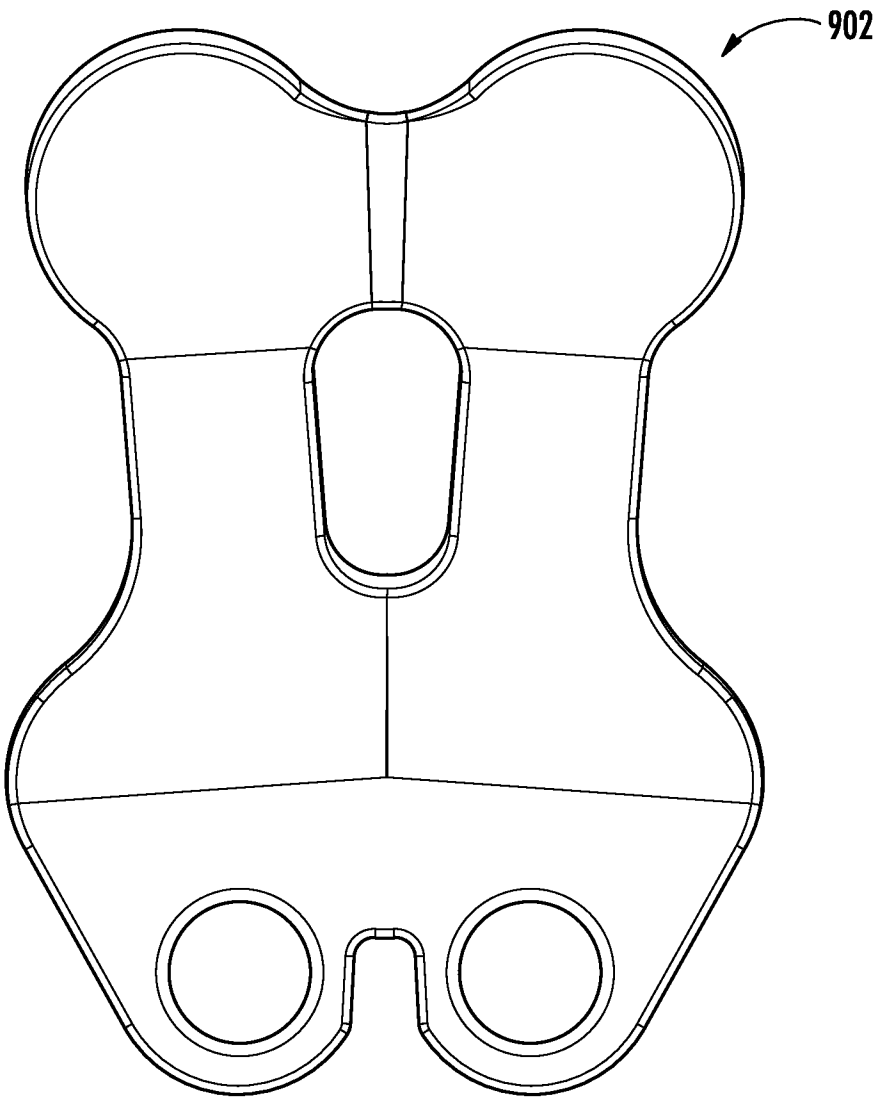
FIG. 24 is a plan view of another alternate backer.
Figure 23:
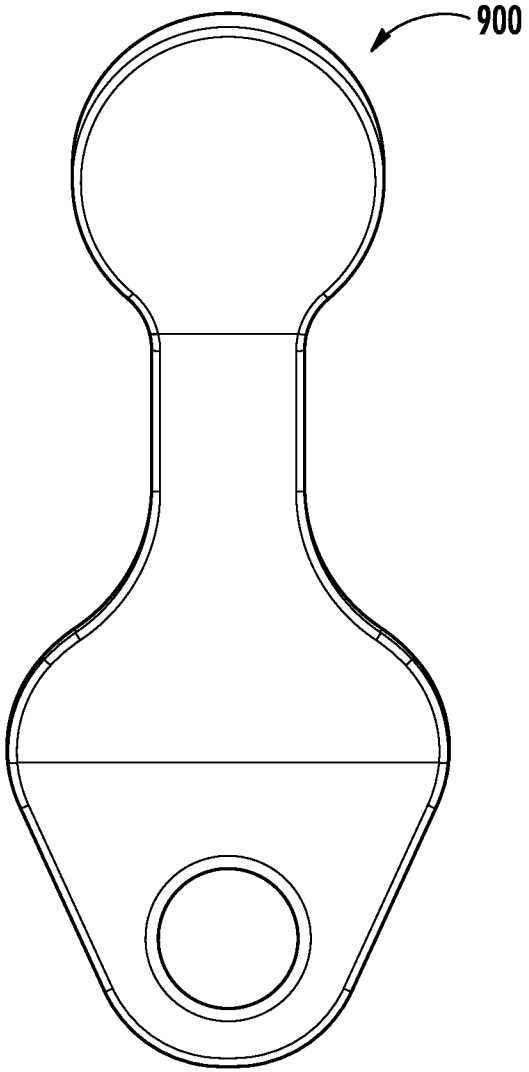
FIG. 23 is a plan view of another alternate backer.

FIGS. 23 and 24 respectively show alternative backers 900 and 902 which also have relatively wide proximal trunk portions. The exemplary backer 900 is shown having a single trunk and single lobe. It also has an exemplary single mounting hole. However, multiple mounting hole embodiments of single-lobe backers are possible and there may be additional mounting features (e.g., one or more pin holes in addition to the bolt holes). Similarly, the backer 902 of FIG. 24 is a two-lobe, two-trunk embodiment. This, also, has two mounting holes, although other embodiments are similarly possible. Other variations involve reed configuration such as separate reeds for each port in a cylinder sharing a common backer.

The compressor may be manufactured via otherwise conventional manufacturing techniques. The pistons and cylinder block may be cast and machined as may other components. The valve plate may be machined from plate stock. The reeds may be cut from sheet stock. The backer may be stamped and/or cut from metallic plate stock (e.g., steel such as cold rolled steel). The stamping process may impart the bends and may optionally cut the planform (although these may alternatively be sawn or otherwise machined/cut). Similarly, the mounting holes may be stamped or machined such as via drilling.

Although an embodiment is described above in detail, such description is not intended for limiting the scope of the present disclosure. It will be understood that various modifications may be made without departing from the spirit and scope of the disclosure. For example, when implemented in the reengineering of an existing compressor configuration, details of the existing configuration may influence or dictate details of any particular implementation. Accordingly, other embodiments are within the scope of the following claims.

What is claimed is:

1. A backer (111) for a reed valve (96), the backer having:
a first surface (113) for engaging the valve reed (102);
a second surface (114) opposite the first surface;
a base portion (112) for mounting to a valve plate (80);
a distal portion (242) for engaging a distal portion (212) of the reed; and
at least one trunk (230) connecting the base portion to the distal portion, the first surface being transversely convex along a portion of the trunk,
wherein:
the distal portion comprises a plurality of lobes (232A, 232B, 232C);
the at least one trunk comprises a plurality of trunks (230A, 230B, 230C); and
the plurality of trunks are relatively wider near the base portion than near the distal portion, with first and second outboard trunks of the plurality of trunks each have a lateral protrusion protruding outboard laterally beyond the base portion surrounding an adjacent bolt hole.

2. The backer of claim 1 wherein:
the plurality of lobes is a plurality of contiguous lobes.

3. The backer of claim 2 wherein:
the plurality of trunks and the plurality of lobes are equal in number.

4. The backer of claim 3 wherein:
the number is three.

5. The backer of claim 1 wherein:
the base portion has exactly two bolt holes.

6. The backer of claim 1 wherein:
the width of the trunk at a location 35% of a span from a proximal end is at least 15% greater than the width of the trunk at a location 35% of the span from a distal end.

7. The backer of claim 1 wherein:
the width of the trunk at a location 30% of a span from a center (580A, 580B) of a mounting hole (202) to a center of a lobe (232A, 232C) is at least 15% greater than the width of the trunk at a location 30% of the span from the center of the lobe to the center of the mounting hole.

8. The backer of claim 1 wherein:
an inter-trunk gap has a length of 10-30% of a span from a center of a mounting hole to a center of a lobe.

9. The backer of claim 1 wherein:
the backer consists essentially of stamped steel.

10. A compressor valve assembly (96) comprising:
a valve plate (80) having:
a mounting surface (120) portion;
a port (92); and
a seat (220) surrounding the port;
the backer of claim 1; and
a reed (102) having:
a base (106) mounted to the mounting surface portion sandwiched between the mounting surface portion and the base portion of the backer; and
a distal portion (110) positioned to flex between a closed condition closing the port and an open condition clear of the port.

11. The compressor valve assembly of claim 10 wherein:
there are a plurality of said ports.

12. The compressor valve assembly of claim 11 wherein:
the reed is a single reed mounted to control flow through the plurality of said ports.

13. The compressor valve assembly of claim 10 wherein:
the reed lacks protrusions corresponding to the backer lateral protrusions so that the backer has a planform proportionately wider than a planform of the reed near the base portion compared with near the distal portion.

14. The compressor valve assembly of claim 10 wherein:
the width of the trunk at a location 30% of the span from the proximal end is at least 15% greater than the width of a corresponding trunk of the reed at said location.

15. The compressor valve assembly of claim 10 wherein:
the width of the trunk at a location 30% of the span from a center of a mounting hole to a center of a lobe is at least 15% greater than a width of a trunk of the reed at said location.

16. A compressor (20) comprising:
a case (22) having at least one cylinder (30-32) and the valve assembly of claim 10;
a crankshaft (38); and
for each of said cylinders:
a piston (34) mounted for reciprocal movement at least partially within the cylinder;
a connecting rod (36) coupling the piston to the crankshaft; and
a pin (44) coupling the connecting rod to the piston, the pin having: first (52) and second (53) end portions mounted in first and second receiving portions of the piston; and a central portion (48) engaging the connecting rod.

17. The compressor of claim 16 wherein:
the valve assembly is a discharge valve.

18. The compressor of claim 16 wherein:
there are a plurality of said ports.

19. The compressor of claim 18 wherein:
the reed is a single reed mounted to control flow through the plurality of said ports.

* * * * *